US008175506B2

(12) United States Patent
Takahashi et al.

(10) Patent No.: US 8,175,506 B2
(45) Date of Patent: May 8, 2012

(54) BELT DRIVING CONTROLLER AND IMAGE FORMING DEVICE

(75) Inventors: Minoru Takahashi, Yokohama (JP); Koichi Kudo, Yokohama (JP); Jun Yamane, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 503 days.

(21) Appl. No.: 12/402,682

(22) Filed: Mar. 12, 2009

(65) Prior Publication Data

US 2009/0234498 A1 Sep. 17, 2009

(30) Foreign Application Priority Data

Mar. 14, 2008 (JP) ..... 2008-066091

(51) Int. Cl.
*G03G 15/01* (2006.01)
*G03G 15/16* (2006.01)

(52) U.S. Cl. ..... 399/302; 399/167; 399/301

(58) Field of Classification Search ..... 399/301, 399/302, 162, 167; 347/116
See application file for complete search history.

(56) References Cited

U.S. PATENT DOCUMENTS

| | | | | |
|---|---|---|---|---|
| 6,925,279 | B2 | 8/2005 | Kamoshita et al. | 399/303 |
| 2002/0034400 | A1 * | 3/2002 | Asuwa et al. | 399/162 X |
| 2006/0110189 | A1 * | 5/2006 | Matsuda et al. | 399/301 |
| 2006/0280523 | A1 * | 12/2006 | Sakai | 399/167 |
| 2007/0126837 | A1 | 6/2007 | Takahashi et al. | 347/104 |
| 2008/0159784 | A1 * | 7/2008 | Seto | 399/167 |
| 2009/0220277 | A1 * | 9/2009 | Andoh et al. | 399/167 |

FOREIGN PATENT DOCUMENTS

| | | |
|---|---|---|
| JP | 6-263281 | 9/1994 |
| JP | 9-114348 | 5/1997 |
| JP | 11-24507 | 1/1999 |
| JP | 2000-356936 | 12/2000 |
| JP | 2003-241535 | 8/2003 |
| JP | 2004-220006 | 8/2004 |
| JP | 2004-229353 | 8/2004 |
| JP | 2006-154575 | 6/2006 |
| JP | 2006-160512 | 6/2006 |

OTHER PUBLICATIONS

Office Action mailed Jan. 10, 2012, in Japanese Patent Application No. 2008-066091, filed Mar. 14, 2008.

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

A belt driving controller includes a driving roller connected to a driving axis, a plurality of driven rollers, an endless belt provided to surround the driving roller and the driven rollers in a tensioned state, a motor connected to the driving axis via a reduction mechanism; a first detector provided near the driving axis and configured to detect a rotation angle of the driving axis, a second detector configured to detect a displacement of the endless belt, and a control unit configured to control driving of the endless belt.

16 Claims, 19 Drawing Sheets

BELT DRIVING CONTROLLER AND IMAGE FORMING DEVICE

PRIORITY CLAIM

The present application is based on and claims priorities from Japanese Patent Application No. 2008-066091, field on Mar. 14, 2008, the disclosure of which is hereby incorporated by reference in its entirety.

BACKGROUND OF THE INVENTION

1. Field of the Invention

The present invention relates to a controller, which controls driving of an endless belt such as an intermediate transfer belt for use in an image forming device such as a copying machine or a printer, and an image forming device.

2. Description of the Related Art

An image forming device is known as an electrophotographic color image forming device, in which toner images of respective colors formed on a plurality of photoconductor drums, respectively, are sequentially transferred (primary transfer) on a rotatable endless intermediate transfer belt to be superimposed thereon, and the color image transferred on the intermediate transfer belt is transferred on a recording medium such as paper by a secondary transfer member.

In such an image forming device, if the running speed of the intermediate transfer belt varies, positions onto which the toner images of respective colors are superimposed, respectively, are misaligned, resulting in an image failure such as a color shift image. In order to prevent the variation in the running speed of the above intermediate transfer belt, a driving system for the intermediate transfer belt includes a belt driving controller (for example, reference to JP2000-356936A).

In the invention described in JP2000-356936A, the running speed of the image forming belt (intermediate transfer belt) is controlled according to the speed information filtered by a filtering unit which enhances a specific frequency component from the running speed information of the image forming belt detected by a detector.

In the invention described in JP2000-356936A, the influence of the variation in the thickness of the belt and the eccentricity of the driving roller relative to the running speed of the intermediate transfer belt (hereinafter referred to as a belt) can be controlled by feedback-controlling the surface speed of the belt. The influence of regular disturbance such as friction relative to the running speed of the belt can be also controlled by feedback-controlling the speed of the motor. However, in order to control the influence of the variation of the reduction mechanism and the rotation of the driving motor relative to the running speed of the belt, it is necessary to compensate the influence by means of the feedback control system for the belt surface speed. For this reason, the control loop of the feedback control system for the belt surface speed is required to respond to a frequency higher than the variation of the reduction mechanism and the rotation of the motor.

However, it is necessary for a response frequency of the control system to be higher than a mechanical resonance frequency (generally, 1000 Hz or below) for use in the image forming device, in order to avoid the resonance of the belt driving system for use in the image forming device. Because of this restriction, the response frequency of the control system required for controlling the influence of the variation of the reduction mechanism and the eccentricity of the motor can not be used in the control loop of the feedback control system for the belt surface speed. For example, if the resonance frequency of the belt driving system is 500 Hz and the rotation frequency of the motor is 40 Hz, the response frequency of the control system which can be set is 500 Hz or more. For this reason, the disturbance of 40 Hz by the motor can not be controlled by the control loop of the feedback control system for the belt surface speed.

Since the variation of the reduction mechanism and the eccentricity error of the motor can not be detected by an encoder which detects the rotation speed of the motor, the influence of the variation of the reduction mechanism and the eccentricity of the driving motor relative to the running speed of the belt can not be controlled even when a high response frequency can be set.

In JP2000-356936A, a filter for controlling the eccentricity of the driving roller is disposed in series in the feedback control system for the belt surface speed, but it is required to prepare a parameter of the filter for each speed mode in the image forming device including a plurality of speed modes. If the filter is disposed in the feedback control system which can not increase the response frequency, failures occur such as the increase in the influence of the phase lag or the interference with the mechanical resonance frequency of the belt driving system. Therefore, the factor which destabilizes the feedback control system is further increased.

FIGS. 25A, 25B are graphs each illustrating a frequency response of a belt surface speed (a) and a driving axis speed (b). As will be noted from the figures, when the frequency is the mechanical resonance frequency of the intermediate transfer belt or more, the phase of the belt surface speed delays, and the eccentricity of the reduction mechanism and the rotation of the motor relative to the running speed of the belt can not be controlled only by the feedback control for the belt surface speed.

SUMMARY OF THE INVENTION

It is, therefore, an object of the present invention to provide a belt driving controller, which has a feedback control system loop for a belt surface speed capable of responding to a frequency higher than a variation of a reduction mechanism and rotation of a motor, can control the variation of the reduction mechanism and the eccentricity of the motor, and also can drive a belt with high accuracy, and an image forming device.

In order to achieve the above object, the present invention provides a belt driving controller, including: a driving roller connected to a driving axis; a plurality of driven rollers; an endless belt provided to surround the driving roller and the driven rollers in a tensioned state; a motor connected to the driving axis via a reduction mechanism; a first detector provided near the driving axis and configured to detect a rotation angle of the driving axis; a second detector configured to detect a displacement of the endless belt; and a control unit configured to control driving of the endless belt when driving by rotation of the motor, the control unit, having: a first speed calculator configured to calculate a surface speed of the endless belt according to a detected signal input from the second detector; a second speed calculator configured to calculate a driving axis speed according to a detected signal input from the first detector; a first speed control loop including a first speed compensator configured to compensate the surface speed of the endless belt by the comparison between a target speed of the endless belt and the surface speed of the endless belt calculated by the first speed calculator; and a second speed control loop including a second speed compensator configured to compensate the driving axis speed by the comparison between an output of the first speed compensator and an output of the second speed calculator.

Preferably, the second detector is configured to detect the displacement of the endless belt by detecting a marker provided in the endless belt, the control unit includes a digital calculator configured to perform control calculation, the first speed calculator is configured to calculate the surface speed of the endless belt with software of the digital calculator in accordance with a pulse signal generated by the marker provided in the endless belt, and the second speed calculator is configured to calculate the rotation speed of the driving axis with the software of the digital calculator in accordance with an output pulse signal of the first detector.

Preferably, in the first speed calculator, a speed difference is obtained by the comparison between the target speed of the endless belt and the surface speed of the endless belt, and a low-pass filtering process is conducted on the speed difference, and then the value calculated by the filtering process is provided to the first speed compensator.

Preferably, the first speed compensator includes an integral element in a control calculation in the control unit.

Preferably, in the first speed calculator, a speed difference is calculated by the comparison between the target speed of the endless belt and the surface speed of the endless belt, an integration calculation is conducted, and then the calculated value is provided to the first speed compensator.

Preferably, the second speed control loop includes a filtering unit configured to extract only a predetermined frequency from a speed difference between a target speed of the driving axis which is input to the second speed control loop and is the output of the first speed compensator and the driving axis speed which is the output of the second speed calculator and an adder configured to multiply the output of the filtering unit by a predetermined gain, and add the calculated value to the output of the second speed compensator.

Preferably, the second speed control loop includes a filtering unit configured to extract only a predetermined frequency from the driving axis speed which is the output of the second speed calculator, and an adder configured to multiply the output of the filtering unit by a predetermined gain, and add the calculated value to the output of the second speed compensator.

Preferably, the calculation in the filtering unit is performed by the second speed calculator.

Preferably, the belt driving controller further includes a switching section configured to switch the target speed of the second speed control loop into the output of the first speed compensator or a value in which the target speed of the belt is multiplied by a predetermined gain.

Preferably, the belt driving controller further includes an adder configured to multiply the target speed of the belt by a predetermined gain, and add the calculated value to the output of the first speed compensator, wherein the output of the adder is used as a target speed of the second speed control loop.

Preferably, the belt driving controller further includes a switching section configured to turn on or off the output of the first speed compensator as a target speed of the second speed control loop.

Preferably, the first speed compensator sets a response frequency of the first speed control loop higher than a frequency of variation in a thickness of the endless belt and a rotation frequency of the driving axis.

Preferably, the second speed compensator sets a response frequency of the second speed control loop higher than a rotation frequency of the motor.

Preferably, the first speed compensator includes a unit configured to control a mechanical resonance generated by at least one of an inertia moment of the driving and driven rollers, a rigidity of the endless belt, and a rigidity of the connected portion of the reduction mechanism.

The present invention also provides an image forming device having a belt driving controller, the belt driving controller including: a driving roller connected to a driving axis; a plurality of driven rollers; an endless belt provided to surround the driving roller and the driven rollers in a tensioned state; a motor connected to the driving axis via a reduction mechanism; a first detector provided near the driving axis and configured to detect a rotation angle of the driving axis; a second detector configured to detect a displacement of the endless belt; and a control unit configured to control driving of the endless belt when driving by rotation of the motor, the control unit including: a first speed calculator configured to calculate a surface speed of the endless belt according a detected signal input from the second detector; a second speed calculator configured to calculate a driving axis speed according to a detected signal input from the first detector; a first speed control loop having a first speed compensator configured to compensate the surface speed of the endless belt by the comparison between a target speed of the endless belt and the surface speed of the endless belt calculated by the first speed calculator; and a second speed control loop having a second speed compensator configured to compensate the driving axis speed by the comparison between an output of the first speed compensator and an output of the second speed calculator.

Preferably, the endless belt is an intermediate transfer belt on which a plurality of color images formed on photoconductors, respectively, is superimposed to be transferred.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION OF THE PREFERRED EMBODIMENTS

Hereinafter, embodiments of the present invention will be described with reference to the drawings.

(Embodiment 1)

An image forming device in this embodiment is an electrophotographic color image forming device such as a copying machine or a printer having an endless intermediate transfer belt. A belt driving controller in this embodiment is an example applied for the driving control of the intermediate transfer belt rotating in the image forming operation.

Figure 2:
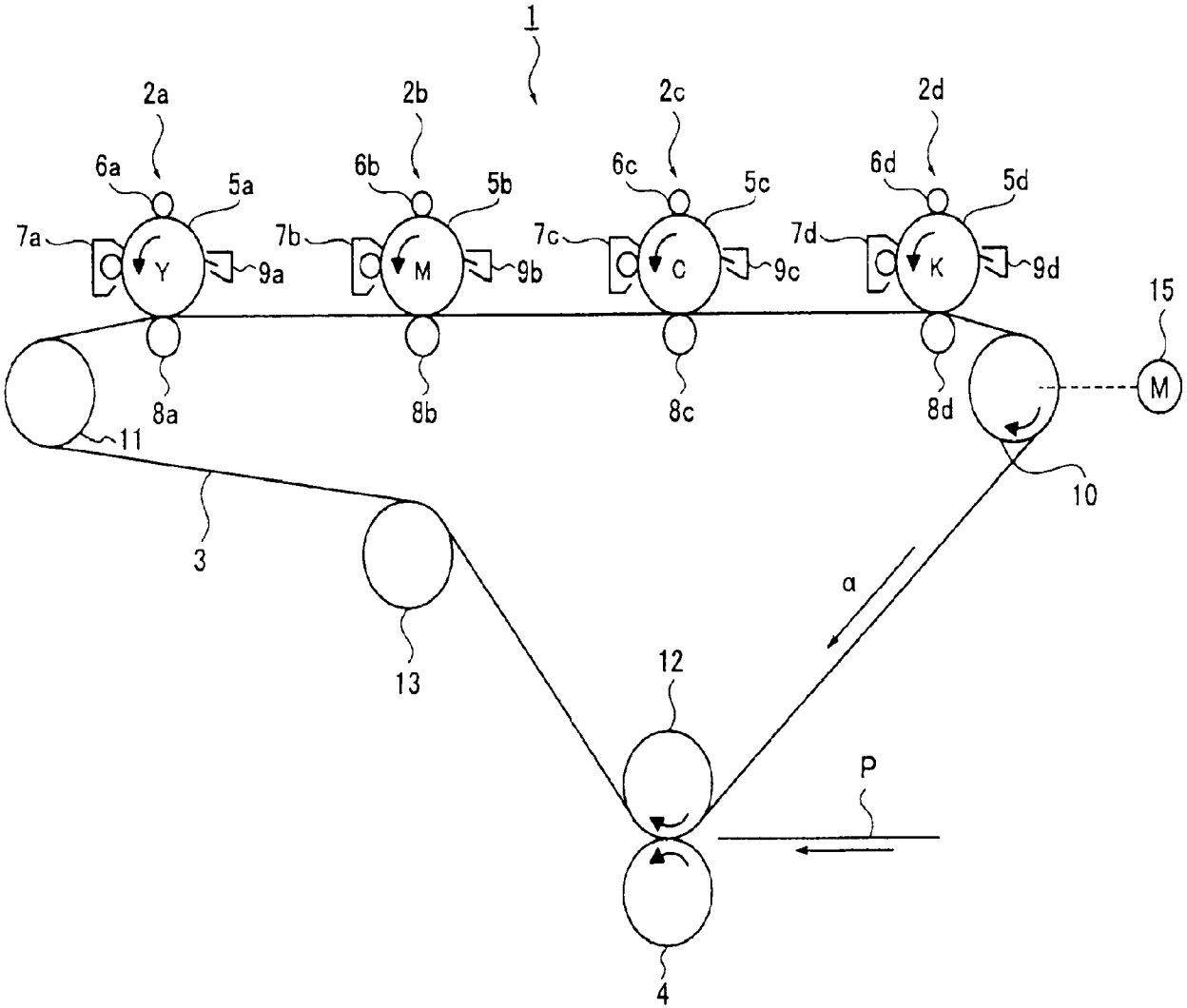
FIG. 2 is a side view illustrating a substantial part of the image forming device according to Embodiment 1 of the present invention.

Referring to FIG. 2, an image forming device 1 according to this embodiment includes four image forming stations 2*a*, 2*b*, 2*c*, 2*d*, an endless intermediate transfer belt 3 onto which a full-color toner image is transferred (primary transfer) with the four-color toner images (yellow, magenta, cyan, black) formed on the image forming stations 2*a*, 2*b*, 2*c*, 2*d*, respectively, superimposed, and a secondary transfer roller 4, which transfers (secondary transfer) the full-color toner image primary transferred onto the surface of the intermediate transfer belt 3 onto a recording material P such as paper.

Each of the image forming stations 2*a*, 2*b*, 2*c*, 2*d* includes a photoconductor drum 5*a*, 5*b*, 5*c*, 5*d*, a charging roller 6*a*, 6*b*, 6*c*, 6*d*, a development unit 7*a*, 7*d*, 7*c*, 7*d*, a primary transfer roller 8*a*, 8*b*, 8*c*, 8*d*, and a cleaning unit 9*a*, 9*b*, 9*c*, 9*d*. The development units 7*a*, 7*b*, 7*c*, 7*d* contain yellow, magenta, cyan and black toners (developer), respectively.

The intermediate transfer belt 3 is provided to surround inside thereof a driving roller 10, a driven roller 11 and a facing roller 12 in a tensioned state, and moves (rotates) in the arrow alpha ($\alpha$) direction by the rotation of the driving roller 10. One face of the intermediate transfer belt 3 located on the image forming station 2*a*-2*d* side moves a nip portion between each photoconductor drum 5*a*-5*d* and each primary transfer roller 8*a*-8*d*. A predetermined tensional force is applied to the intermediate transfer belt 3 by a tension roller 13. The outer circumference face of the intermediate transfer belt 3 facing the facing roller 12 has contact with a secondary transfer roller 4.

Figure 1:
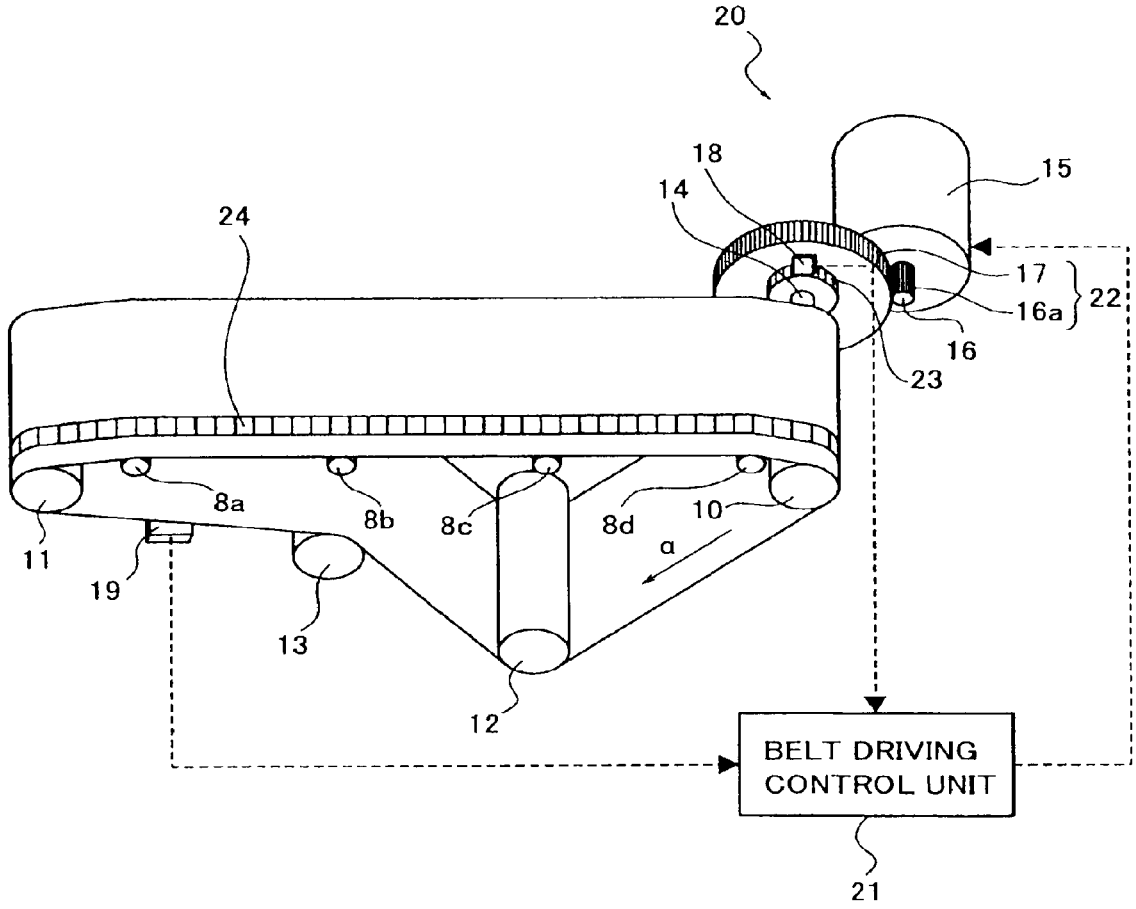
FIG. 1 is a diagram illustrating a substantial part of an image forming device including a belt driving controller according to Embodiment 1 of the present invention.

As illustrated in FIG. 1, a reduction gear 17 engaged with a gear 16*a* formed in a motor axis 16 of a motor 15 is disposed between a driving axis 14 integrally coupled to the driving roller 10 and the motor axis 16. An encoder sensor (rotary encoder) 18 is provided near the driving axis 14 on the reduction gear 17 side, and an encoder sensor (linear encoder) 19 is provided near the intermediate transfer belt 3. The intermediate transfer belt 3 which moves (rotates) by the rotation of the driving roller 10 is controlled by the after-mentioned belt driving controller 20.

In the image forming operation, the surface of each photoconductor drum 5*a*-5*d* rotating in the arrow direction at a predetermined process speed is uniformly charged by each charging roller 6*a*-6*d*, and an electrostatic latent image corresponding to the input image information is formed on the surface of each photoconductor drum 5*a*-5*d* by the exposure with laser light from an exposure unit (not shown). The toner of each color (yellow, magenta, cyan and black) is adhered onto the electrostatic latent image on the surface of each photoconductor drum 5*a*-5*d* by each development unit 7*a*-7*d*, and the electrostatic latent image on each drum is developed (visualized). The yellow toner image, the magenta toner image, the cyan toner image and the black toner image are thereby formed on the surfaces of the photoconductor drums 5*a*-5*d*, respectively.

These toner images are transferred (primary transfer) on the intermediate transfer belt 3, which rotates by the driving of the driving roller 10, by the primary transfer rollers 8*a*-8*d* to which transfer bias voltage is applied, so that the toner images are sequentially superimposed, and a full-color toner image is formed on the intermediate transfer belt 3. In accordance with this toner image, the recording material P such as paper is fed to the secondary transfer portion between the intermediate transfer belt 3 and the secondary transfer roller 4, and the full-color toner image is transferred (secondary transfer) on the recording material P. The recording material P on which the full-color toner image is transferred is fed to a fuser unit (not shown), and the recording material P on which the toner image is fused by the fuser unit (not shown) is discharged.

The residual toner adhered onto the surface of each photoconductor drum 5*a*-5*d* is eliminated by each cleaning unit 9*a*-9*d*, and also the residual toner adhered onto the surface of the intermediate transfer belt 3 is eliminated by a cleaning unit (not shown).

In the meanwhile, if the belt surface speed (movement speed) of the intermediate transfer belt 3 is varied in the above-described image forming operation, the position where the four toner images are superimposed may be misaligned and the toner image may be extracted and contracted. For this reason, image failure such as a color shift image or a gray image may be formed when transferring the image on the recording material P.

As the factor for varying the surface speed of the intermediate transfer belt 3, the friction load, the eccentricity and the load fluctuation of a rotating body (for example, the intermediate transfer belt 3, the driving roller 10, the driven roller 11, the facing roller 12, the driving axis 14, and the motor 15), the change in the thickness of the intermediate transfer belt 3, the attachment eccentricity and the load variation of the reduction gear 17, the attachment eccentricity of the encoder sensor (in this embodiment, the encored sensor 18 is attached to the driving axis 14, but it was conventionally attached to the motor 15), the unstable rotation of the motor 15, the torque variation by the ON/OFF of a clutch (not shown), and the entry of paper are considered.

Considering these as the disturbance factors relative to the surface speed of the intermediate transfer belt 3, since the friction load is constant and the vibration caused by the friction load has an extremely low frequency, the influence of the friction load is likely to be controlled by conducting the feedback control. Since the change in the thickness of the intermediate transfer belt 3 also has a low frequency, compared to the various changes in the rotating body, if the surface speed can be directly detected, the influence of the change in the thickness can be controlled by conducting the feedback control using the detected speed. On the other hand, in the factors for varying the rotating body, the eccentricity of the reduction gear 17 and the unstable rotation of the motor 15 have a frequency close to a mechanical resonance frequency (hereinafter, referred to as a mechanical resonance frequency of the intermediate transfer belt mechanism) or below generated by the rigidity of the rotating body and the intermediate transfer belt 3 and the rigidity of the connection section between the driving axis 14 and the reduction gear 17.

For this reason, in the conventional structure having an encoder sensor attached to a driving motor and a control system for feedback controlling the surface speed of the intermediate transfer belt 3, the response frequency of the control system becomes less than or equal to a response frequency of the mechanical resonance frequency of the intermediate transfer belt mechanism. Therefore, the influence of the above-described disturbance factors can not be completely controlled because of an insufficient gain, and the belt can not be accurately driven.

In this embodiment, as illustrated in FIG. 1, the belt driving controller 20, which controls the driving (movement or rotation) of the intermediate transfer belt 3 according to the output from the encoder sensor 18 for detecting the rotation angle of the driving axis 14 and the output from the encoder sensor 19 for detecting the displacement of the intermediate transfer belt 3, is provided. In FIG. 1, the photoconductors 5*a*-5*d* and the like on the intermediate transfer belt 3 are omitted.

As illustrated in FIG. 1, in this embodiment, the rotation speed of the motor 15 is reduced by the reduction mechanism 22 constituted of the engagement between the gear 16*a* formed in the motor axis 16 and the reduction gear 17. The driving axis 14 is coupled to the reduction gear 17 of the reduction mechanism 22. As the reduction mechanism 22, a structure having a plurality of gears in line or a planetary gear train may be used. The encoder sensor 18 is disposed near the driving axis 14 connected to the reduction mechanism 22. The encoder sensor 18 reads the slits of a code wheel 23 attached to the rotation axis 14.

The encoder sensor 18 outputs a digitized signal according to the rotation of the code wheel 23 as sensor output. This sensor output may be two-phase digitized signals each having a different phase at 90°, a single-phase analogue signal, or a two-phase analogue signal. In this embodiment, the intermediate transfer belt 3 has a single driving direction, which does not require the control of normal rotation and reverse rotation, so that the two-phase output is not always required. However, in the image forming device which requires a constant speed performance and a stop performance (for example, an image forming device which forms an image by using one photoconductor drum with a plurality of processes), the two-phase output may be required.

An encoder pattern 24 is inscribed on the front surface of the intermediate transfer belt 3. The pattern is provided near the end portion of the belt 3. The encoder sensor 19 reads this encoder pattern 24, so that the surface speed of the rotating belt is detected. In FIG. 1, the encoder sensor 19 is disposed between the tension roller 13 and the driven roller 11, but the encoder sensor 19 can be disposed in any position as long as the position is flat for accurately detecting the surface speed of the belt. The encoder sensor 19 can be disposed between the driven roller 11 and the driving roller 10, or between the driving roller 10 and the facing roller 12, for example. If the encoder sensor 19 is disposed on each roller, the sensor is affected by the curvature of the roller. The surface speed of the belt can not be accurately detected because the intervals of the encoder pattern 24 change by the manufacturing variation in the thickness of the intermediate transfer belt 3 and the variation in the thickness caused by environmental change. Therefore, it is not preferable to dispose the encoder sensor on each roller. In addition, the encoder pattern 24 can be provided in the back face of the intermediate transfer belt 3.

Any method can be used for manufacturing the encoder pattern 24. For example, a sheet-like pattern can be attached to the intermediate transfer belt 3, a pattern can be directly formed on the intermediate transfer belt 3, or a pattern can be integrally provided in the manufacturing process of the intermediate transfer belt 3. In this embodiment, it is expected that the encoder sensor 19 is a reverberatory optical sensor having slits at equal intervals, but any sensor can be used as long as it can accurately detect the surface speed of the belt according to the encoder pattern 24. For example, the surface speed of the belt can be detected by an image process using a CCD camera or the like. If a Doppler method or a sensor method which detects the surface speed of the belt from the irregularity of the surface by the image process is used, the encoder pattern 24 can be omitted.

The output of the encoder sensor 18 and the output of the encoder sensor 19 are input to a belt driving control unit 21, and the speed of the driving axis 14 (driving roller 10) and the surface speed of the intermediate transfer belt 3 are calculated according to the output of each sensor. In the belt driving control unit 21, predetermined control calculation is performed according to the calculated result, and the command value which is the result of the control calculation is output to a motor driver 36 (reference to FIG. 3), and the driving motor 15 is driven according to the command value.

The motor 15 may be a brush motor or a brushless motor. The driving circuit of the motor driver 36 is changed according to the type of the motor 15. A voltage control type motor driver or a current control type motor driver can be used as the motor driver 36. If the current control type motor driver is used, the driver is not affected by the temporal change and the environmental change. Any value can be used for the command value to the motor driver, such as an analogue value, a digital value, a PWM or the like, as long as the motor driver can output in proportion to the command value. The motor driver 36 may be PWM driving or linear driving. The control calculation can be conducted in analogue or digital, but the control calculation by a digital calculator such as a CPU or a DSP is general, and the contents of the control calculation are described by software. If the control calculation is simple operation logic, which does not change a calculation parameter, the control calculation can be conducted by hardware logic.

Figure 3:
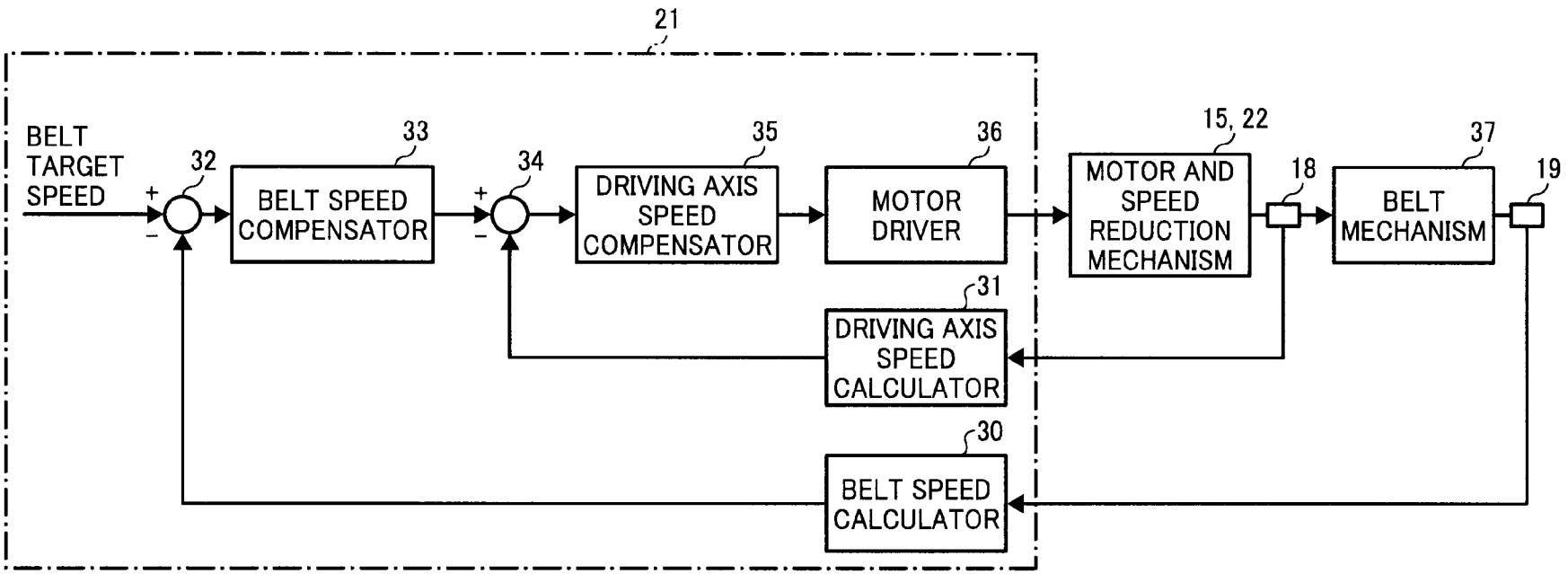
FIG. 3 is a block diagram illustrating a structure of the belt driving controller according to Embodiment 1 of the present invention.

Referring to FIG. 3, the belt driving control unit 21 includes a belt speed calculator 30 as a first speed calculator, a driving axis speed calculator 31 as a second speed calculator, a first comparator 32, a belt speed compensator 33, a second comparator 34, a driving axis speed compensator 35, and a motor driver 36. The belt speed calculator 30 calculates the surface speed of the intermediate transfer belt 3 according to the output of the encoder sensor 19. The driving axis speed calculator 31 calculates the speed of the driving axis according to the output of the encoder sensor 18.

The rotation speed of the motor 15 is reduced by the reduction mechanism 22 (gear 16*a* and reduction gear 17). The intermediate transfer belt 3 drives (moves or rotates) in the arrow a direction by the rotation of the driving axis 14 and the driving roller 10 connected to the reduction gear 17. If the intermediate transfer belt 3 is driven by the driving roller 10, the facing roller 12, the tension roller 13, and the driven roller 11 are driven to rotate according to the driving (movement or rotation) of the intermediate transfer belt 3 (hereinafter, the intermediate transfer belt 3, the driving roller 10, the facing roller 12, the tension roller 13 and the driven roller 11 are referred to as a belt mechanism 37).

The information of the encoder pattern 24 on the intermediate transfer belt 3 when driving the belt mechanism 37 is read by the encoder sensor 19. The belt speed calculator 30 calculates the belt speed according to the output input from the encoder sensor 19, and calculates the surface speed of the moving (rotating) intermediate transfer belt 3. The calculated surface speed information is fed back to the first comparator 32. The slits of the code wheel 23 attached to the driving axis 14 are read by the encoder sensor 18. The driving axis speed calculator 31 calculates the speed of the rotating driving axis 14 according to the output input from the encoder sensor 18, and calculates the driving axis speed. The calculated driving axis speed is fed back to the second comparator 34.

Since the encoder sensor 18 for the driving axis 14 is a rotary encoder, and the encoder sensor 19 for the intermediate transfer belt 3 is a linear encoder, the unit systems are different to each other. In general, a rotation speed is rad/s, and a linear speed is m/s. Accordingly, it is necessary to convert the speeds obtained by these two encoders into the rotation speed or the linear speed. When they are unified to the surface speed of the belt, the unit is m/s, and it is required to contain a coefficient for converting a unit in the driving axis speed calculator 31, in order to convert the driving axis speed. The driving axis speed comparator 35 also includes a coefficient in accordance with m/s. On the other hand, the speed obtained by the two encoders is unified to the driving axis speed, the unit is rad/s, and it is required for the belt speed compensator 33 to have a coefficient for converting into rad/s.

Next, the driving control of the intermediate transfer belt 3 by the belt driving control unit 21 will be described with reference to the flow chart in FIG. 4.

The belt surface speed is calculated by the belt speed calculator 30 according to the output from the encoder sensor 19, and the driving axis speed is also calculated by the driving axis speed calculator 31 according to the output from the encoder sensor 18 (Step S1).

The belt target speed output from a belt target speed calculator (not shown) and the belt surface speed calculated by the belt speed calculator 30 are compared in the first comparator 32, and the difference between the speeds is output. This difference between the belt speeds is input to the belt speed compensator 33, and the driving axis target speed is output. This driving axis target speed and the driving axis speed calculated by the driving axis speed calculator 31 are compared in the second comparator 34, and the difference between the driving axis speeds is output. The driving axis speed compensator 35 calculates the motor voltage value according to the input difference of the speeds (Step S2). This motor voltage value is converted into a PWM value, and the converted value is input to the motor driver 36 (Step S3), so that the driving motor 15 rotates and drives.

Figure 4:
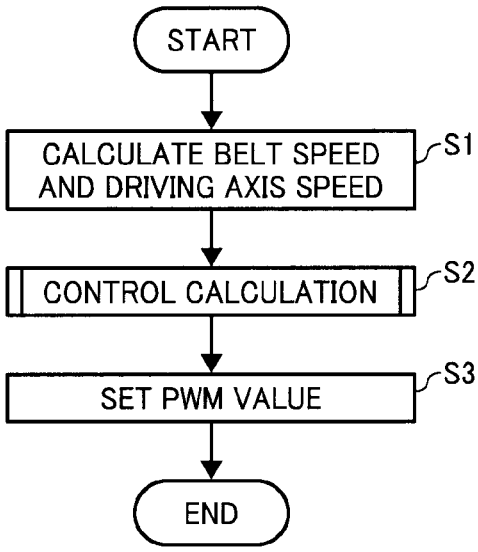
FIG. 4 is a flow chart illustrating the driving control of an intermediate transfer belt by a belt driving control unit.

In the flow chart illustrated in FIG. 4, the two speeds (belt surface speed and driving axis speed) are obtained at the beginning, but each speed can be obtained before calculating the speed difference in the belt speed control loop (first speed control loop) and the speed difference in the driving axis speed control loop (second speed control loop). Moreover, the belt speed control loop and the driving axis control loop are calculated in the same control cycle, but these can be calculated in control cycles different to each other. In this case, since it is necessary for the response speed of the control loop set in the inner side of the control loop to be faster than the response speed of the control loop set in the outer side of the control loop, it is required to be "control cycle of driving axis speed control loop≦control cycle of belt speed control loop".

When calculating in the same control cycle, it is necessary to prepare the control cycle which can achieve the response frequency required for the driving axis speed control loop. This control cycle is generally 10 times or more of the response frequency. In Step S3, the PWM value corresponding to the motor voltage is set to the motor driver 36, but an analogue voltage value or a digital value which is the output of a D/A converter is required when the motor driver is analogue input or digital input. When the motor driver 36 is a current control driver, a value corresponding to a current command value can be set by a PWM, an analogue value or a digital value.

Next, the belt speed calculator 30 will be described. The belt speed calculator 30 conducts F/V conversion to a pulse interval by hardware, and outputs the converted interval as a voltage corresponding to a speed. The speed counter, which measures an interval from one edge (rising edge or falling edge) of a pulse to the edge of the next pulse with a standard clock, may be constituted of hardware. In this case, the distance between the pulses/(count value of speed counter×standard clock cycle) is a speed.

The inverse number of the speed counter is proportional to the speed. When the calculator such as a CPU or a DSP has a sufficient calculation performance even if the calculator conducts the control calculation or the like, the edge of the pulse is detected by constantly observing the IO port to which the pulse is input, the pulse interval is measured by a program, and the speed is calculated by the software process. In this case, it is necessary for the frequency observing the IO port to be sufficiently higher than the frequency of the output of the encoder.

However, in order to more effectively use the calculator, another method can be used. In such a method, interrupt is generated with one edge (rising edge or falling edge) of a pulse by using the interrupt of the calculator such as a CPU or a DSP, the time of the pulse interval is measured by the difference between the time when the interrupt is generated and the time of the previous interrupt, and the speed is calculated by calculating "distance between pulses/time of pulse interval". The time of the pulse interval is measured by counting a standard clock with a clock counter prepared in the calculator as hardware. However, the speed calculation process and the control of the clock counter are processed as software.

Consequently, when the speed calculation is performed by the interrupt process, the processing time of the speed calculation is increased if the pulse frequency is fast, and the control calculation as a main calculation may not be completed within a predetermined time. Therefore, it is important to estimate various calculation times. As another method, when using a calculator equipped with OS, the speed can be calculated with software calculation by the interrupt process of the software which is the function of the OS. In this case, if the interrupt process of the software is compared to the interrupt process of the calculator, variability in time may be increased, resulting in the deterioration in the accuracy of the speed calculation compared to the interrupt process of hardware.

When the information of the code wheel 24 attached to the driving axis 14 is read by the encoder sensor 18, and is output as pulse output, the speed calculation to be conducted in the driving axis speed calculator 31 is achieved by the structure similar to that in the belt speed calculator 30. When calculating the speed with the software calculation by using the interrupt process of the calculator, another port different from the interrupt port and the IO port for use in the belt speed calculator 30 is generally used. When the interrupt calculation is conducted, the software calculation moves to a routine different from that in the belt speed calculator 30, and a dedicated process is conducted.

Hereinafter, an example using the interrupt process routine of the calculator such as a CPU or a DSP for the speed calculation will be described.

When the double speed control loop as illustrated in FIG. 3 is provided, and the control calculation cycle with the first comparator 32, the belt speed compensator 33, the second comparator 34 and the driving axis speed compensator 35 is different from the speed calculation cycle with the belt speed calculator 30 and the speed calculation cycle with the driving axis speed calculator 31, the control calculation is periodically performed by the timer interrupt of the calculator (cycle A), and the speed is calculated by the edge cycle of the pulse as described above (belt speed calculation: cycle B, driving axis speed calculation: cycle C), for example.

Figure 5:
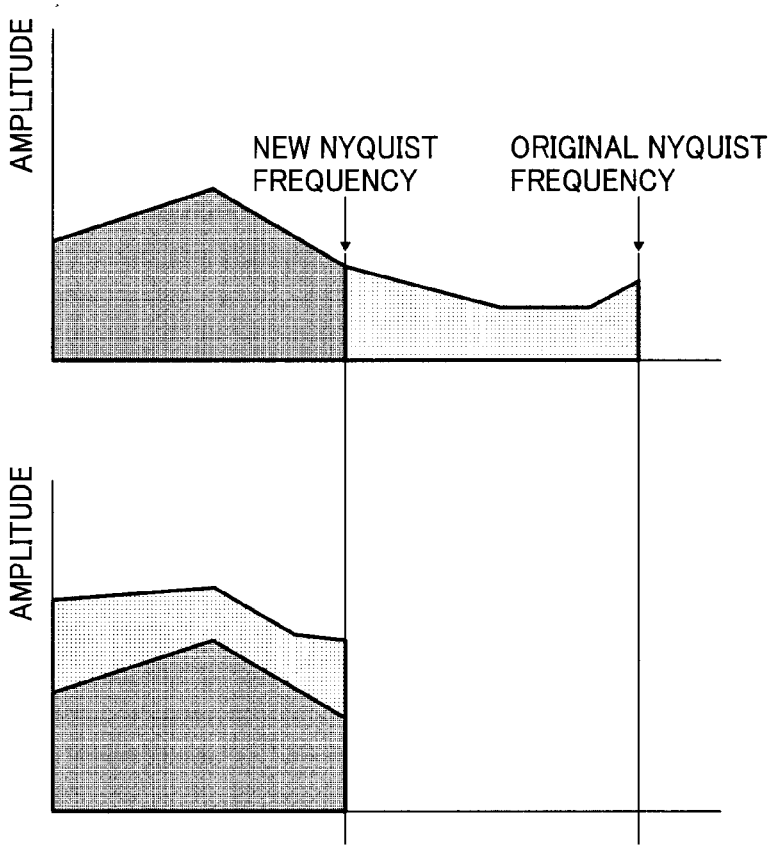
FIG. 5 is a view illustrating an original frequency in the upper view and a frequency after downsampling in the lower view.

When the cycle A is longer than the cycle B and the cycle C (low frequency), if the calculation results of the cycle B and the cycle C are provided to the calculation routine of the cycle A, the down-sampling occurs (generally, cycle A≧cycle B≧cycle C). For this reason, as illustrated in FIG. 5, the frequency component more than or equal to the Nyquist frequency of the cycle A contained in the cycle B or the cycle C occurs as a replication frequency in less than or equal to the Nyquist frequency of the cycle A (generation of aliasing). Thereby, a frequency component which does not actually exist may occur.

Therefore, in the control system, the operation for controlling the variation in the belt driving speed is performed on the frequency component which does not actually exist, so that the unstable rotation of the frequency component which does not mechanically exist may occur because of a signal process.

In the belt speed calculator 30 and the driving axis speed calculator 31, the band frequency is controlled by a low-pass filter process, so as to prevent the generation of the above-described aliasing. As the low-pass filter, an FIR filter or an IIR filter can be used. In the interrupt process routine of the belt speed calculator 30, after conducting the calculation in the belt speed calculator 30 and the first comparator 32, the low-pass filter process for preventing the aliasing can be conducted. Since the calculation in the first comparator 32 is a simple comparison operation, there is no problem for the calculation load if the calculation in the first comparator 32 is input to the interrupt calculation of the speed calculation.

Figure 6:
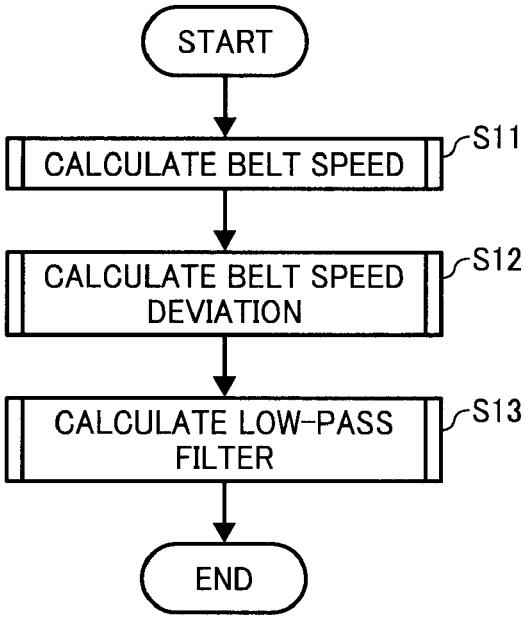
FIG. 6 is a flow chart illustrating an operation which is performed by an interrupt process routine of a belt speed calculator.

The above operation conducted in the interrupt process routine of the belt speed calculator 30 will be described with reference to the flow chart in FIG. 6.

At first, the belt speed is calculated (Step S11). After that a difference between the calculated speed and a target belt speed is calculated (Step S12), and then the low-pass filter calculation is conducted (Step S13).

The driving axis speed control loop is stabilized by the driving axis speed compensator 35, and is controlled to prevent the disturbance factors to be applied to the driving axis speed control loop. When the belt speed control loop is provided outside the driving axis speed control loop, a constant speed difference is generated by the disturbance factors applied to the intermediate transfer belt 3 by just providing a proportional function in the belt speed comparator 33. Therefore, by providing in the belt speed compensator 33 an integral element in the control calculation, the belt speed control loop becomes a type 1, and the difference of the belt speed can be 0. Moreover, if the band frequency is controlled by the low-pass filter in the calculation of the frequency B, the integral element of the belt speed compensator 33 can be calculated with the cycle A.

In the calculation of the cycle B, instead of calculating the low-pass filter, by conducting the calculation of the integral element in the belt compensator 33 with the interrupt routine which is the same as the belt speed calculation of the cycle B, a role which is the same as the control of the band frequency (Gain: −20 dB/dec, power of f (1 rad/s)≦0 d) and a role of the integral element which controls the constant speed difference can be achieved.

Referring to FIG. 3, in the interrupt calculation process routine by the output pulse of the encoder sensor 19, the calculation of the integral element, which is a part of the belt speed calculator 30, the first comparator 32 and the belt speed compensator 33, is conducted. More particularly, the speed difference is integrated each time upon the detection of the speed, so that an accurate position difference can be calculated.

The integral element of a continuous system is expressed as 1/s by Laplas transform, but the integral element of a discrete system is expressed as the following formula (1) or (2) by z transform. In this case, ts is a sampling time and z is one sampling progress.

$$ts/(z-1) \quad (1)$$

$$z \cdot ts/(z-1) \quad (2)$$

Figure 7:
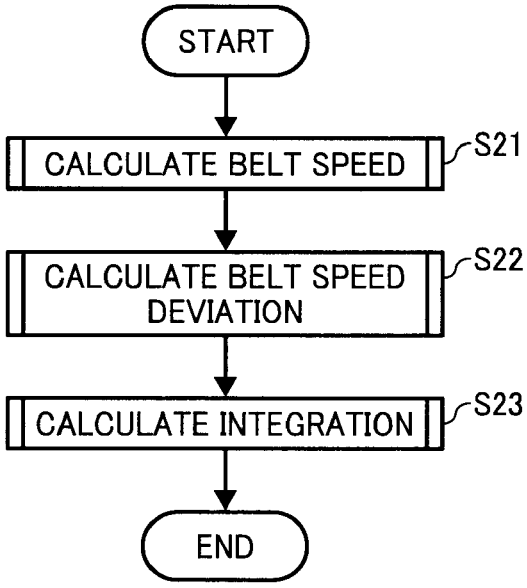
FIG. 7 is another flow chart illustrating the operation which is performed by the interrupt process routine of the belt speed calculator.

The above operation conducted by the interrupt process routine of the belt speed calculator 30 will be described with reference to the flow chart in FIG. 7.

At first, the belt speed is calculated (Step S21), and then the difference between the belt speed and the belt target speed is calculated (Step S22). After that, the integration calculation is conducted (Step S23).

As described above, according to the present embodiment, the first speed control loop having the belt speed comparator 33, which conducts the compensation calculation of the belt surface speed of the moving intermediate transfer belt 3 according to the comparison between the belt target speed and the belt surface speed calculated in the belt speed calculator 30, and the second speed control loop having the driving axis speed comparator 35, which conducts the compensation calculation of the driving axis speed according to the comparison between the output of the belt speed compensator 33 and the output of the driving axis speed calculator 31, are provided. Therefore, the influence (high frequency) of the rotation factors of the motor 15, the reduction mechanism 22 or the like and the influence of the constant disturbance factors can be controlled by the second speed control loop, and the influence (low frequency) of the rotation factor of the rotation axis (rotation roller 10) 14 and the factors such as the variation in the thickness in the intermediate transfer belt 3 can be controlled by the first speed control loop. Accordingly, the belt driving controller capable of driving the belt with high accuracy can be provided.

(Embodiment 2)

Figure 8:
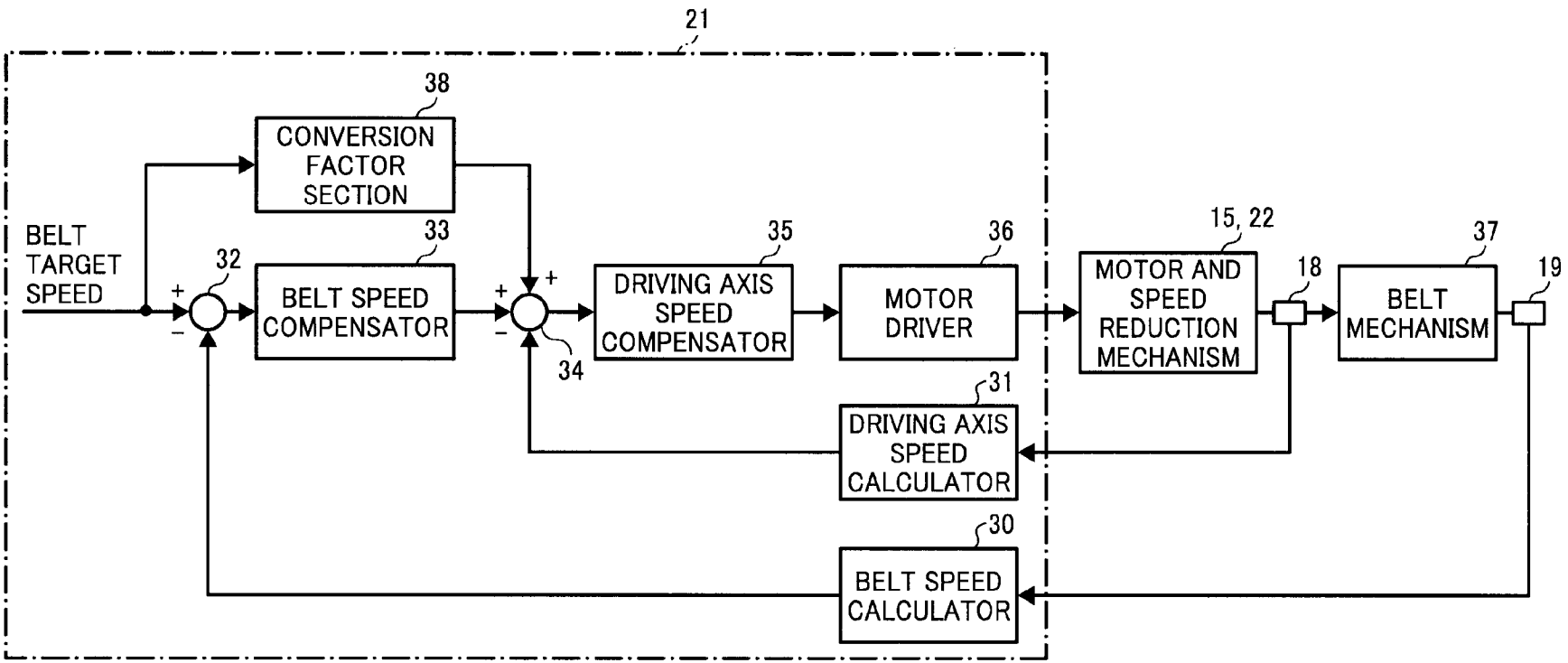
FIG. 8 is a block diagram illustrating a structure of a belt driving controller according to Embodiment 2 of the present invention.

In this embodiment, as illustrated in FIG. 8, a conversion factor section 38 is provided in the belt driving control unit 21 illustrated in FIG. 3. In addition, other structures are the same as the structures in the belt driving control unit 21 illustrated in FIG. 3, so the description thereof is omitted. In this embodiment, by multiplying a conversion factor to the belt target speed, and adding the multiplied value in the second comparator 34 of the driving axis speed control loop, the delay of the response of the belt speed control loop disposed in the outer side of the loop is compensated, so as to quickly respond to the change in the belt target speed. The conversion factor to be multiplied to the belt target speed in this case is a conversion factor when converting the units of the belt surface speed and the driving axis speed, or a value slightly smaller than the conversion factor.

In this case, the driving axis speed control loop mainly operates by the value of the conversion factor from the conversion factor section 38. As the corrected value of the conversion factor section 38, the value is output from the belt speed compensator 33. When such a structure (feed forward) is used, if the belt target speed is rapidly changed, the overshoot of the speed is increased, so that the profile of the belt speed when accelerating should be studied.

(Embodiment 3)

As described above, by providing the double control loop including the belt speed control loop and the driving axis speed control loop, the frequency of the disturbance factors to be controlled can be separated into each of the speed control loops. However, in the image forming device such as a copier or a printer for use as a commercially-available product, the periodical disturbance is large and the mechanical resonance frequency is low, so that the disturbance factors may not be controlled to the target value by the gain which can be set within the stable range of the control system. In this case, since the unstable rotation of the motor which is controlled by the driving axis speed control loop is large, the unstable rotation of the motor can not be controlled even if the gain is set within an area which does not generate the vibration by the mechanical resonance frequency of the driving axis.

Figure 9:
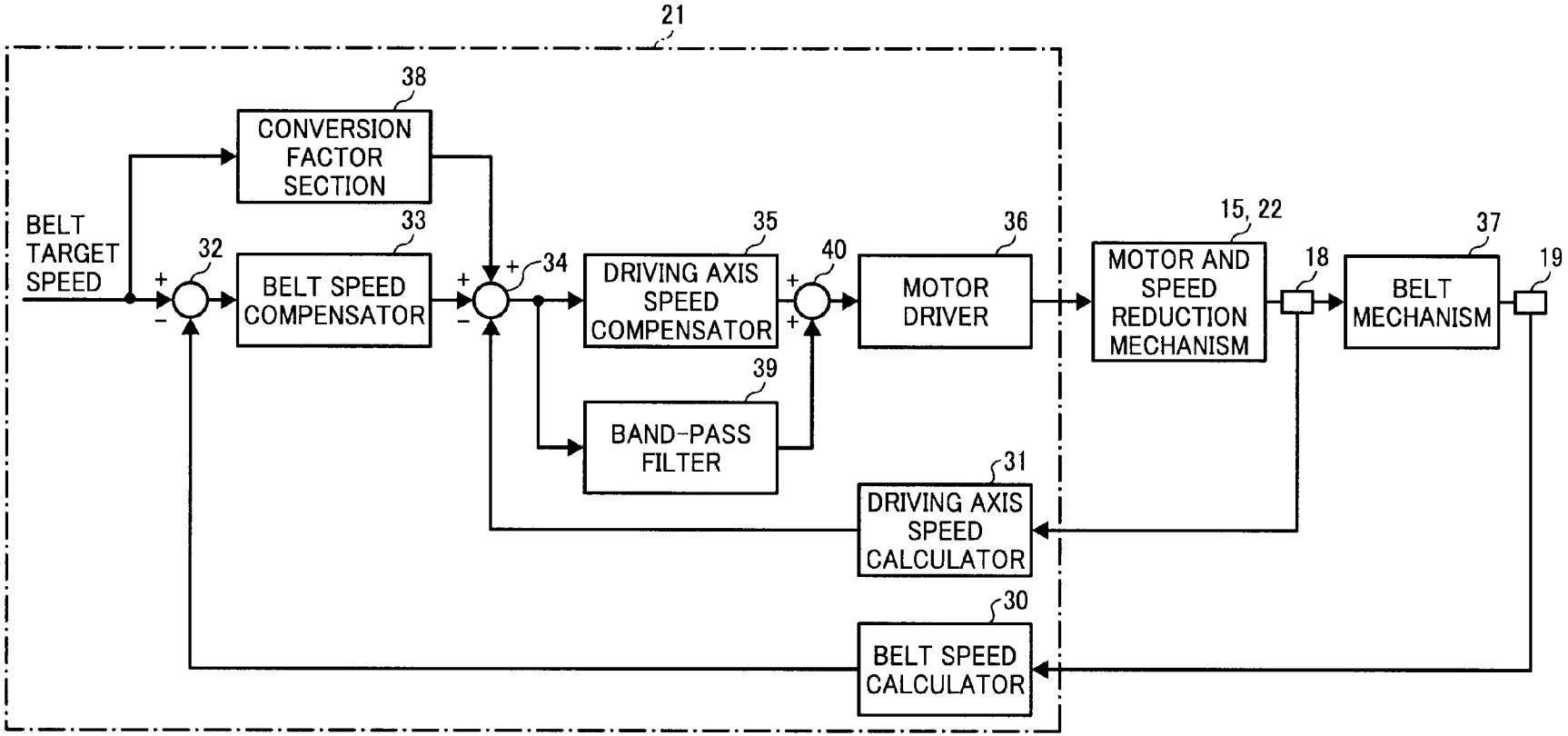
FIG. 9 is a block diagram illustrating a structure of a belt driving controller according to Embodiment 3 of the present invention.

In order to solve the above problem, as illustrated in FIG. 9, the belt driving control unit 21 in this embodiment further includes a band-pass filter 39 and an adder 40. The filtering process which extracts a predetermined frequency is conducted on the difference of the driving axis speeds to be input to the driving axis speed compensator 35 by the band-pass filter 39. After multiplying a predetermined proportional element, it is added to the output of the driving axis speed compensator 35. Other structures are similar to the structures in the belt driving control unit 21 illustrated in FIG. 8, and they can be the same as those in the belt driving control unit 21 illustrated in FIG. 3.

Relative to the difference of the driving axis speeds which is the output of the second comparator 34, a predetermined frequency component (in this case, the rotation frequency of the motor 15) is extracted by the band pass filter 39, and a predetermined gain (gain which lacks for controlling the rotation speed of the motor 15) is multiplied. In the adder 40, the extracted value is added to the output of the driving axis speed compensator 35, and the motor driver 36 is driven by the added value.

[Embodiment 4]

Figure 10:
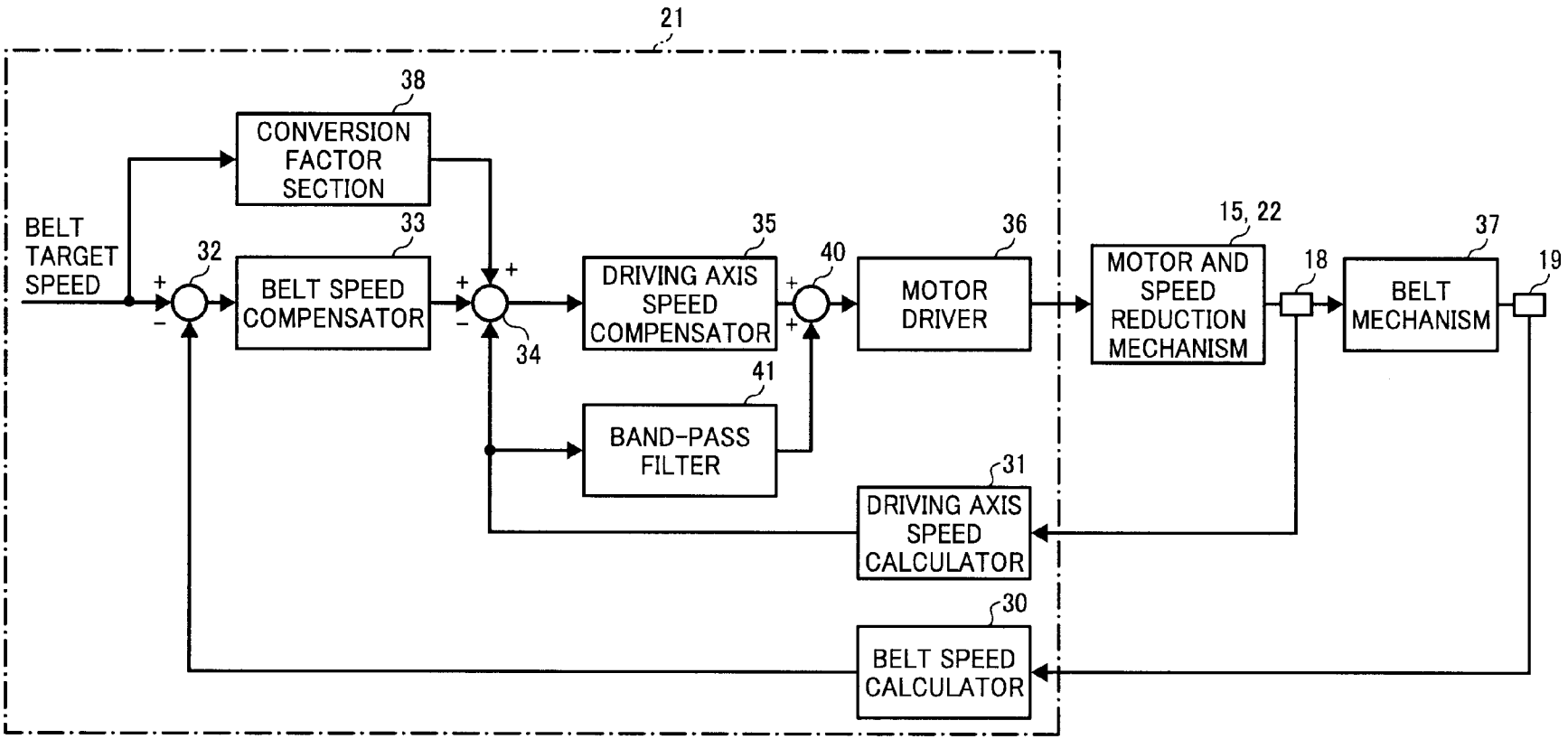
FIG. 10 is a block diagram illustrating a structure of a belt driving controller according to Embodiment 4 of the present invention.

As illustrated in FIG. 10, the belt driving control unit 21 according to the present embodiment performs a filtering process, which extracts a predetermined frequency, on the driving axis speed, which is the output of the driving axis speed calculator 35, by the band-pass filter 41, and adds the output of the driving axis speed compensator 35 after multiplying a predetermined proportional element (gain). Other structures in FIG. 10 are the same as the structures in the belt driving control unit 21 illustrated in FIG. 9.

More particularly, the filtering process, which extracts a predetermined frequency (in this case, rotation frequency of motor 15) with the band-pass filter 41, conducted on the driving axis speed, which is the output of the driving axis speed calculator 35, and a predetermined gain (gain which is short on the control of the rotation speed of the motor 15) is multiplied. In the adder 40, the output value of the band-pass filter 41 and the output of the driving axis speed compensator 36 are added and the motor driver 35 is driven by the added value.

Figure 11A:
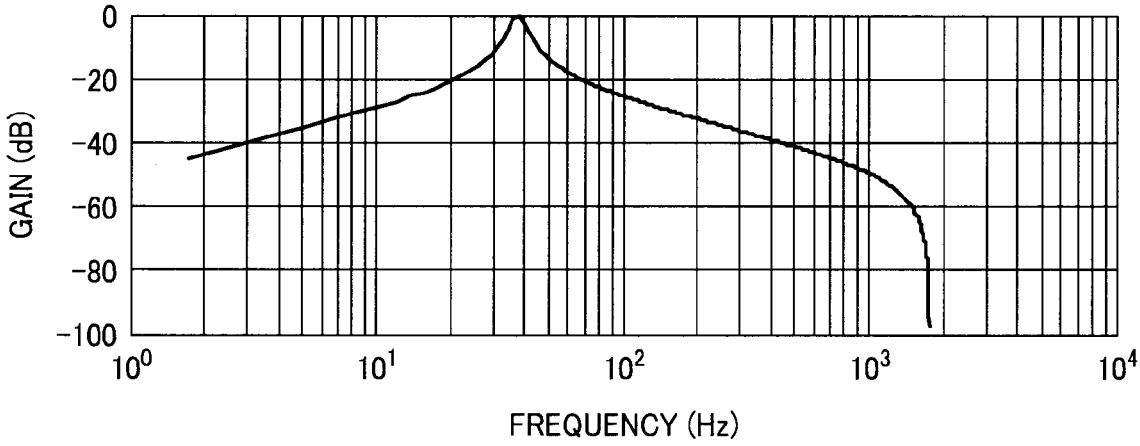
FIG. 11A is a graph illustrating one example of a frequency feature of a band-pass filter.
Figure 11B:
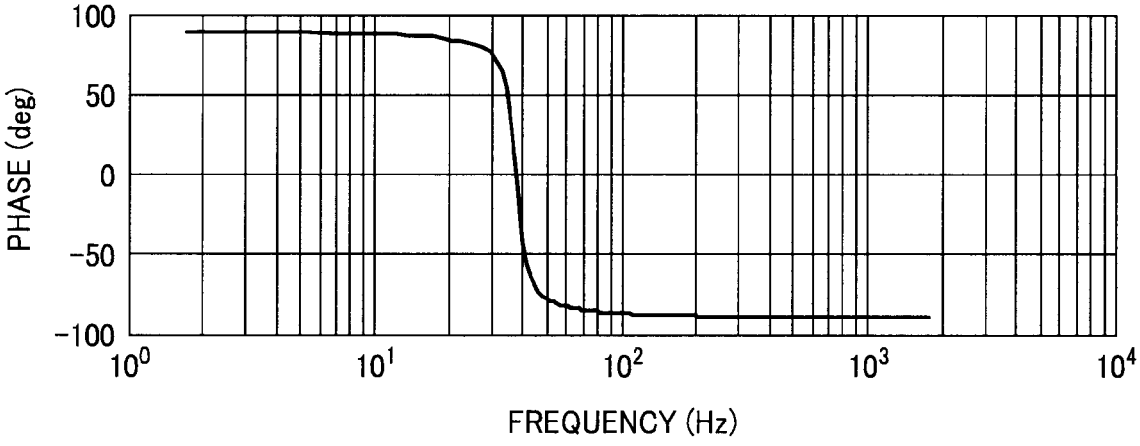
FIG. 11B is a graph illustrating one example of another frequency feature of a band-pass filter.

As the band-pass filters 39, 41 for use in Embodiments 3, 4, it is ideal to use a band-pass filter having a feature which can extract only a specified frequency without causing a phase lag. However, the real feature of the band-pass filter illustrates the frequency feature shown in FIGS. 11A, 11B.

The calculation in each band-pass filter 39, 41 is conducted by a calculation cycle (cycle A) which is the same as that in the driving axis speed compensator 35. The calculation cycle is 500 μs (a sampling frequency of 2 kHz), for example, and the transfer function G of the band-pass filter which extracts a frequency of 38 Hz is expressed by the following formula (3).

$$G=(0.003132-0.003132z-2)/(1-1.98z-2+0.9937z-2) \quad (3)$$

In this case, the band-pass filter is a discrete two-dimension IIR filter, but an FIR filter, a filter having a different dimension or an analogue filter can be used. In a specific frequency to be extracted, when a phase lag occurs, a unit which adds together with a phase or the like is required.

Figure 12A:
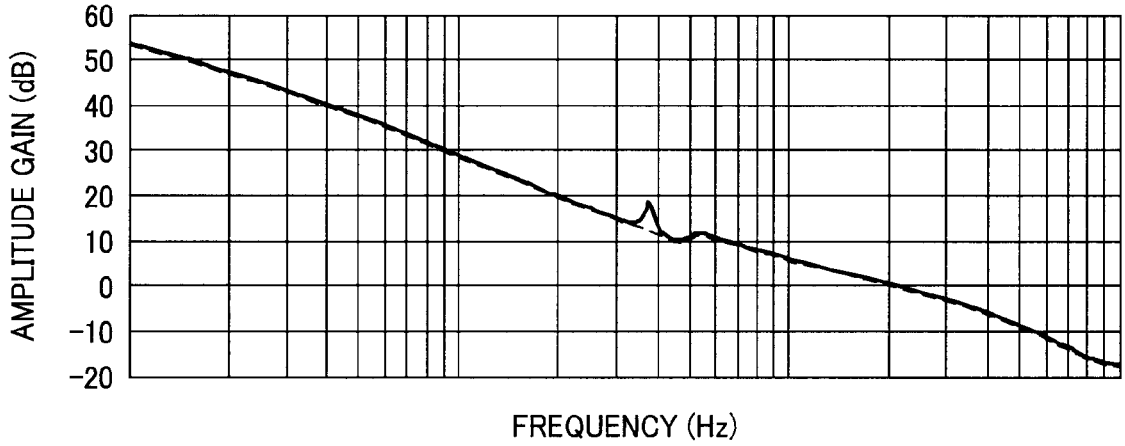
FIG. 12A is a graph illustrating an open-loop frequency response of a driving axis speed control loop with or without the band-pass filter.
Figure 12B:
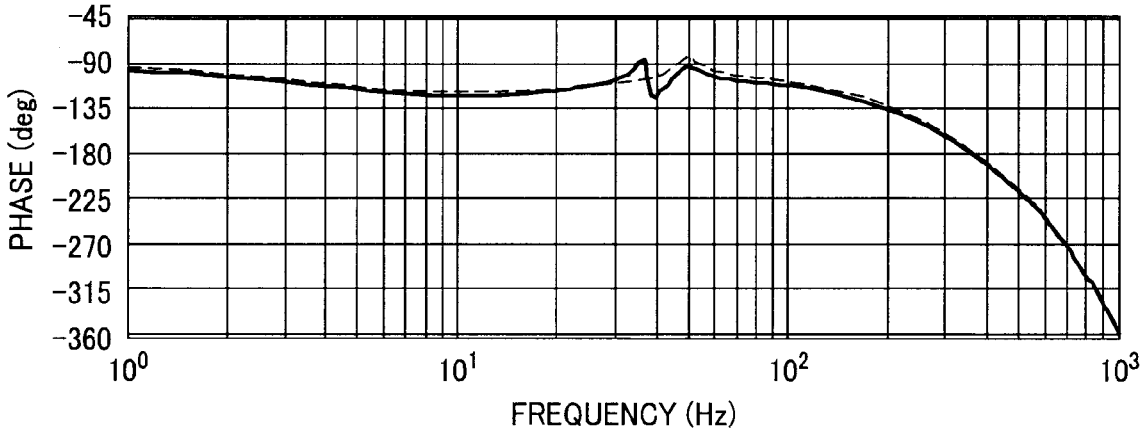
FIG. 12B is a graph illustrating another open-loop frequency response of the driving axis speed control loop with or without the band-pass filter.

FIGS. 12A, 12B are graphs each illustrating an open-loop frequency response of the driving axis speed control loop with or without the band-pass filter. In FIGS. 12, 12B, the solid line indicates when the band-pass filter is used, and the dotted line indicates when the band-pass filter is not used. As illustrated in FIGS. 12A, 12B, a gain of about 38 Hz is increased by the band-pass filter.

Figure 13:
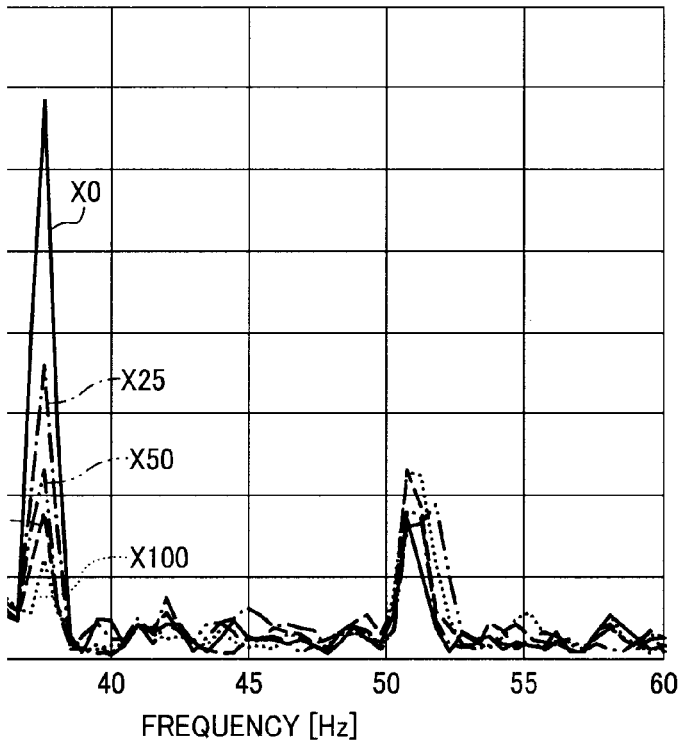
FIG. 13 is a graph illustrating a frequency feature of a driving axis when driving the driving axis speed control loop, and changing a proportional element, which multiples to the extracted signal, from 0 to 100.

FIG. 13 is a view illustrating change in a frequency feature of the driving axis when the proportional element (gain) which multiples to the driving axis speed is changed from 0-100 (×0-×100) by conducting the driving axis speed control loop. By increasing the proportional element, the frequency component of about 38 Hz is decreased. More particularly, a predetermined frequency component can be controlled.

However, as will be noted from FIGS. 11A, 11B, 12A, 12B, the signal extracted by the band-pass filter is associated with the change in the phase. For this reason, if the proportional element is increased, the phase change of the control system is increased, which affects the stability of the control system. As will be also noted from FIG. 13, the frequency component except for the specific frequency (about 38 Hz) is increased. Therefore, the limit of the amplification of the specific frequency by the proportional element is determined by the margin of the phase of the control system.

Figure 14A:
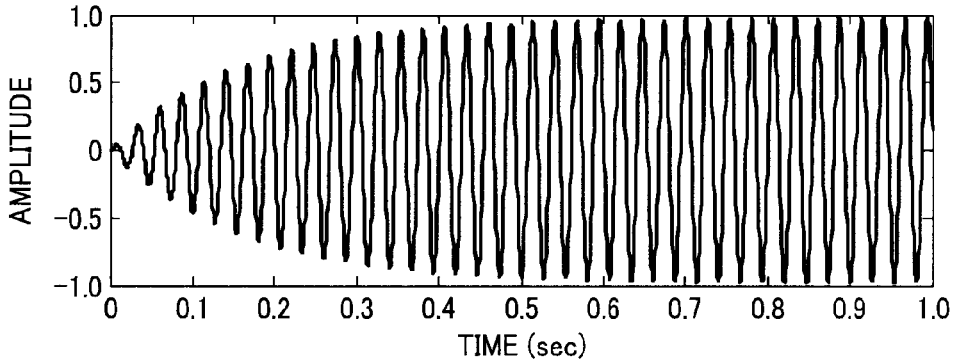
FIG. 14A is a graph illustrating the output of the band-pass filter of the belt driving controller in Embodiment 3.
Figure 14B:
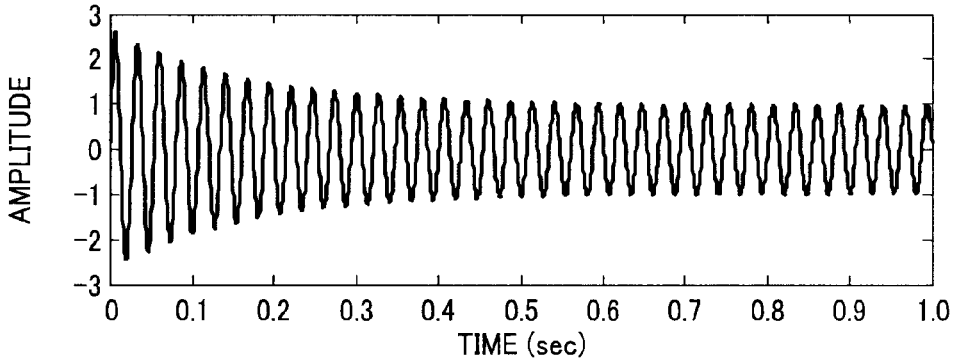
FIG. 14B is a graph illustrating the output of the band-pass filter of the belt driving controller in Embodiment 4.

FIG. 14A is a view illustrating the output of the band-bass filter 39 and FIG. 14B is a view illustrating the output of the band-pass filter 41. In addition, the band-pass filters 39, 41 use the same parameter.

Since the input of the band-pass filter 39 is a speed difference which is the data near 0, the output of the filter is the data near 0. However, since the input of the band-pass filter 41 is a speed in which the initial value is large, the speed becomes a large value until the output of the filter is stabilized. If a sufficient time has passed a filter time constant, the variable number of the filter condition is stabilized, so that the output of both band-pass filters becomes the same. Therefore, when using the band-pass filter, it is necessary to consider the time when the output is stabilized.

Figure 20:
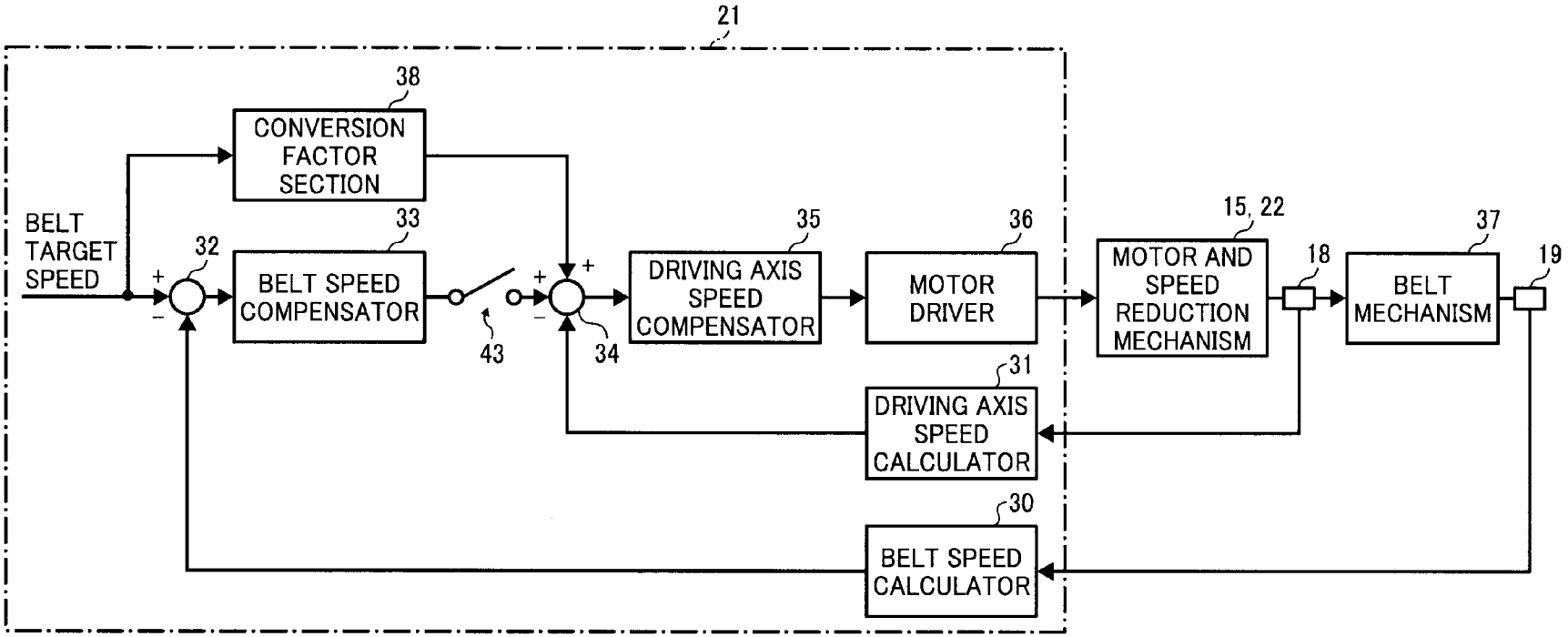
FIG. 20 is a block diagram illustrating a structure of a belt driving controller according to Embodiment 6 of the present invention.

The processes in the adders 40 in FIGS. 9, 20 are the same, but the sign (positive and negative) reverses in the input of the driving axis speed and the input of the driving axis speed difference. Therefore, the processes in the adders 40 are actually different to each other. In the structure of FIG. 10, a process which reverses the reference number in the calculation of the band-pass filter 41, or decreases the output of the band-pass filter 41 from the output of the driving axis speed compensator 35 in the adder 40, is used.

Each of the band-pass filters 39, 41 is configured to extract a predetermined frequency. Therefore, when each filter calculates with the calculation cycle (cycle A) which is the same as the cycle of the driving axis speed compensator 35, and when the calculation cycle is fixed to the cycle A, it is necessary to prepare a parameter of each band-pass filter 39, 41 corresponding to the above formula (3) for each frequency to be extracted. In the image forming device such as a copier or a printer, the driving speed may change according to the image forming mode such as a heavy-paper mode, a color mode, or a black and white mode, so that a plurality of parameters of the band-pass filter corresponding to the speed of each mode is prepared, and the parameter is switched according to the mode.

On the other hand, if the calculation of each band-pass filter 39, 41 is conducted in the interrupt cycle (cycle C) of the driving axis speed calculator 31, the driving axis speed according to the image forming mode is changed, so that the interrupt cycle (cycle C) of the driving axis speed calculator 31 is changed. Thereby, the passing-through frequency of each band-pass filter 39, 41 is automatically changed according to the driving axis speed. Therefore, if one parameter of each band-pass filter 39, 41 which extracts a motor rotation frequency corresponding to the formula (3) is prepared, when the rotation speed of the driving axis is changed by the image forming mode, the rotation frequency of the motor 15 can be always extracted.

Figure 15A:
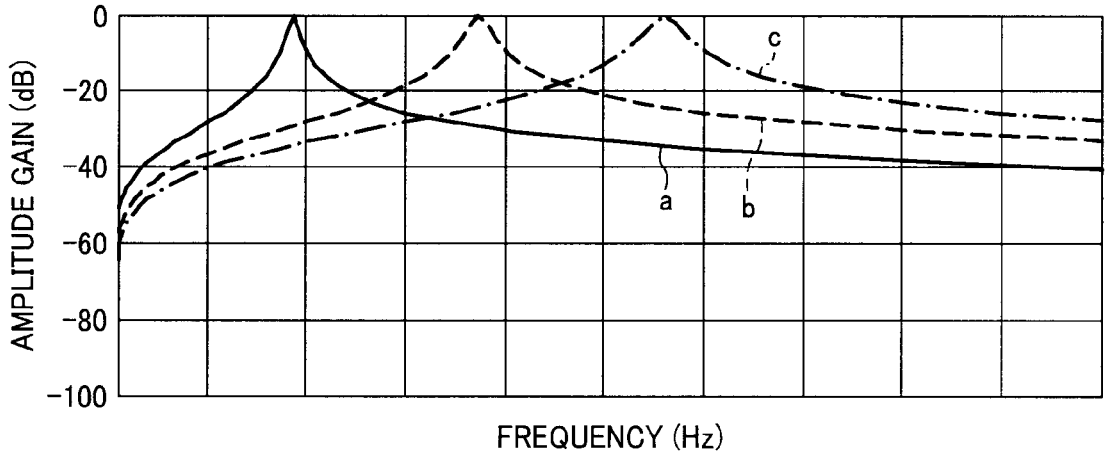
FIG. 15A is a graph illustrating a filter feature when multiplying the sampling frequency of the filter calculation by 0.5 times, 1.0 time, and 1.5 times with the band-pass filter.
Figure 15B:
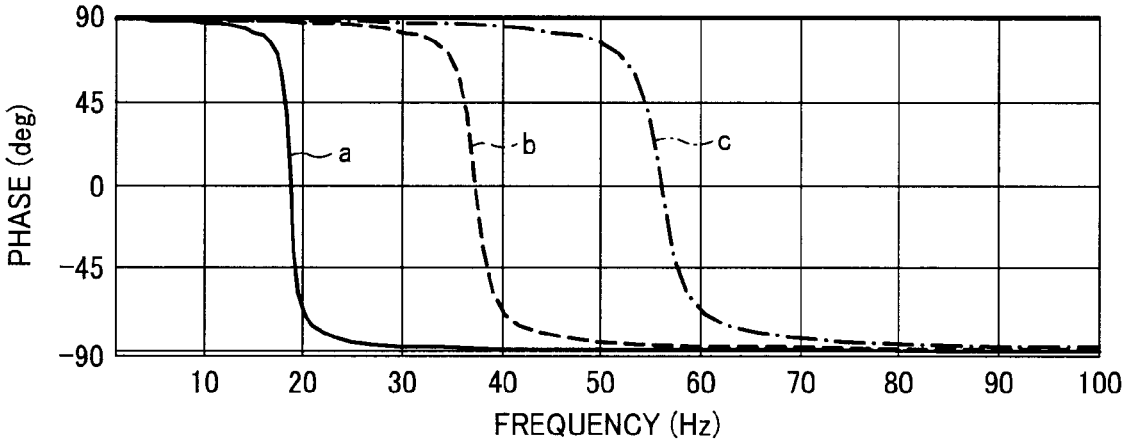
FIG. 15B is a graph illustrating another filter feature when multiplying the sampling frequency of the filter calculation by 0.5 times, 1.0 time, and 1.5 times with the band-pass filter.

FIGS. 15A, 15B are views each illustrating a filter feature when the sampling frequency of the filter calculation is 0.5 times, 1.0 time and 1.5 times (in the figures, a, b, c correspond to Samplings 1, 2, 3, respectively) by using the band-pass filter of the formula (3). As will be noted from FIGS. 15A, 15B, the filter feature is changed according to the change in the calculation cycle.

Figure 16:
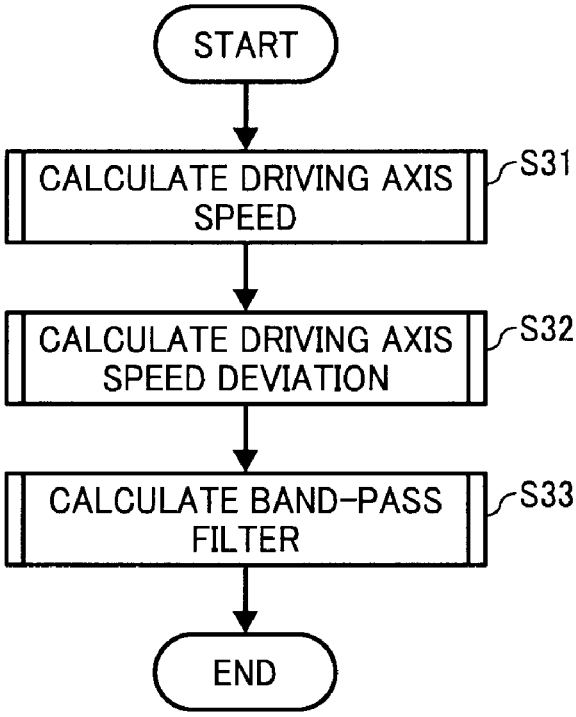
FIG. 16 is a flow chart illustrating the operation which is conducted by the interrupt process routine of the driving axis speed calculator.

The operation which is conducted by the interrupt process routine of the driving axis speed calculator 31 including the calculation of the band-pass filter 39 in FIG. 9 will be described with reference to the flow chart in FIG. 16.

At first, the driving axis speed is calculated (Step S31), and then the driving axis speed difference which is the speed difference between the driving axis target speed (the output of the belt speed compensator 30 or the value in which the feed forward value is added to the output) and the driving axis speed is calculated (Step S32). After that, the calculation of the band-pass filter 39 is conducted from the driving axis speed difference (Step S33).

Figure 17:
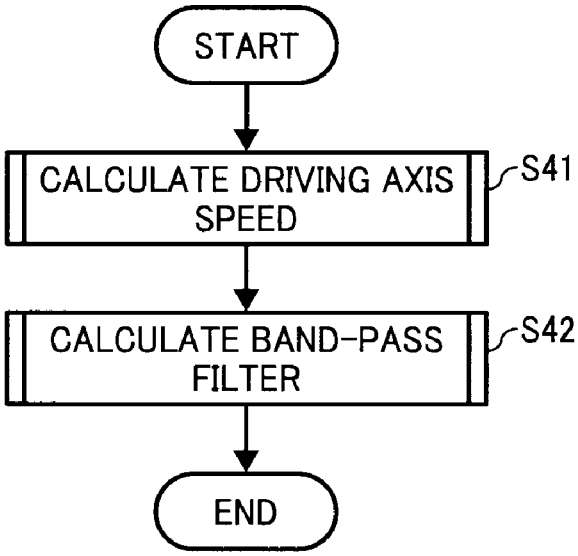
FIG. 17 is another flow chart illustrating the operation which is conducted by the interrupt process routine of the driving axis speed calculator.

The operation which is conducted by the interrupt process routine of the driving axis speed calculator 31 including the calculation of the band-pass filter 41 in FIG. 10 will be described with reference to the flow chart in FIG. 17.

At first, the driving axis speed is calculated (Step S41), and then the calculation of the band-pass filter 41 is conducted from the driving axis speed (Step S42).

[Embodiment 5]

As described in Embodiment 1, the encoder pattern 24 is inscribed on the front face of the intermediate transfer belt 3, this encoder pattern 24 is read by the encoder sensor 19, and the surface speed of the intermediate transfer belt 3 which moves is calculated by the belt speed calculation process. In this case, if a part of the encoder pattern 24 is damaged or is stained for any reason, a defect in which the encoder sensor 19 does not accurately output may occur. Moreover, a user who emphasizes productivity has a demand to use this image forming device until the defect is improved even if a quality of an image is decreased to some degree.

The change in the space between the encoder pattern 24 on the intermediate transfer belt 3 and the encoder sensor 19 leads to the change in the encoder signal (change in pulse interval). For this reason, a unit which does not operate the encoder sensor 19 in a predetermined frequency or below may be provided in the encoder pattern 24. This means that the encoder sensor 19 does not output when starting the driving of the intermediate transfer belt 3.

However, when the encoder sensor 19 does not output, it is necessary to stably drive the intermediate transfer belt. Therefore, in this embodiment, single loop control including only the driving axis speed control loop and double loop control including the driving axis speed control loop and the belt speed control loop can be selectively conducted.

Figure 18:
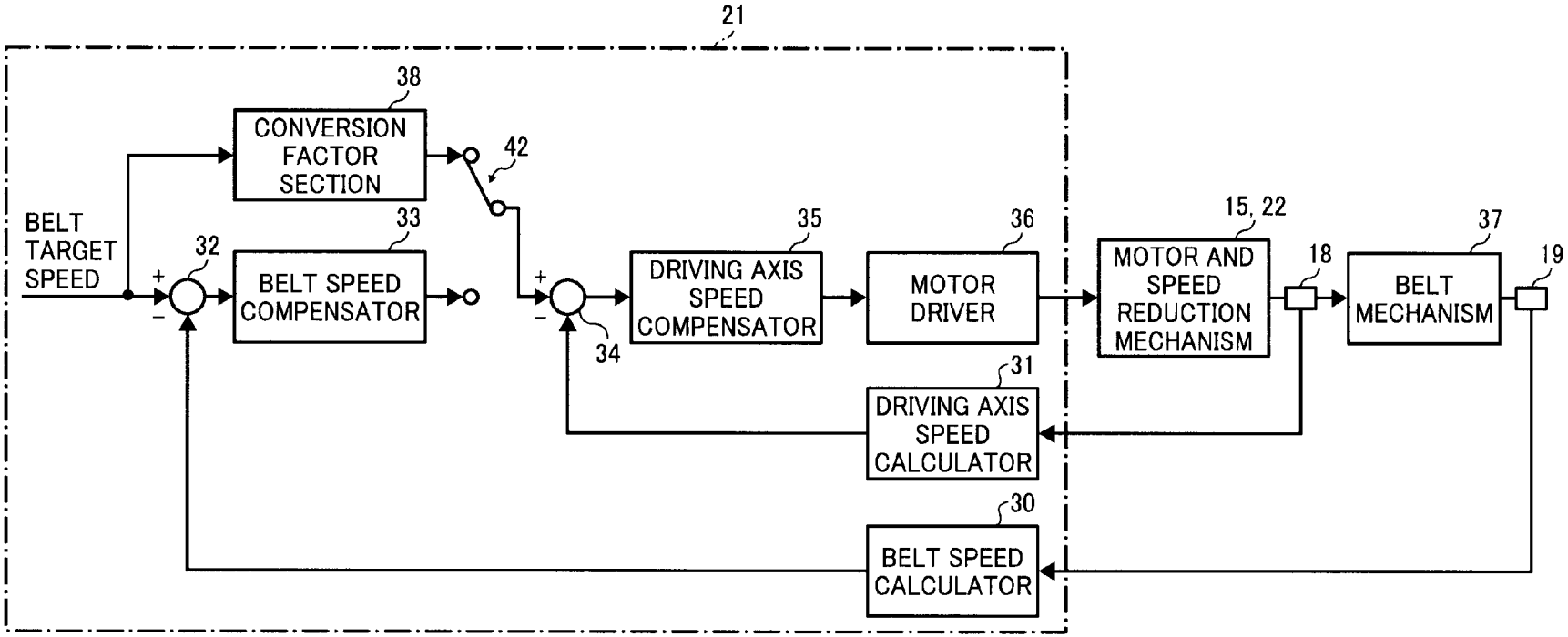
FIG. 18 is a block diagram illustrating the structure of the belt driving controller according to Embodiment 5 of the present invention.

In this embodiment, as illustrated in FIG. 18, a switching section 42 is provided in the belt driving control unit 21 illustrated in FIG. 8. The switching section 42 can be achieved by a hardware switch including a release switch or an analogue switch or a soft wear switch when the calculation of the control system is constituted of software. Other structures are the same as the structures in the driving control unit 21 illustrated in FIG. 8, so the description will be omitted for the same structures.

Hereinafter, the driving control by the belt driving control unit 21 of the present embodiment will be described.

At first, the driving control which makes the surface speed of the intermediate transfer belt 3 constant after the start of the driving will be described. At first, the switching section 42 is switched to a conversion factor section 38, and the belt target speed is converted into the driving axis target speed by the conversion factor section 38. The converted driving axis target speed is input to the second comparator 34 of the driving axis speed control loop via the switching section 42, so as to be compared to the feedback driving axis speed. The difference between the driving axis speeds is input to the driving axis speed compensator 35.

When the driving axis speed reaches a desired speed, the switching section 42 is switched to the belt speed compensator 33 side, so that the control is switched to the double loop control having the driving axis speed loop control and the belt speed control loop from the single loop control including only the driving axis speed control loop. In addition, when the switching section 42 is switched to the belt speed compensator 33 side from the conversion factor section 38 side, the state variable is a value corresponding to the speed difference, and is not a value corresponding to the double loop control because the belt speed difference is previously input to the belt speed compensator 33.

For this reason, the belt speed is decreased in the switching of the switching section 42. In this case, by setting the state variable value corresponding to the double loop control in the switching, the variation in the belt speed in the switching can be reduced.

Figure 19:
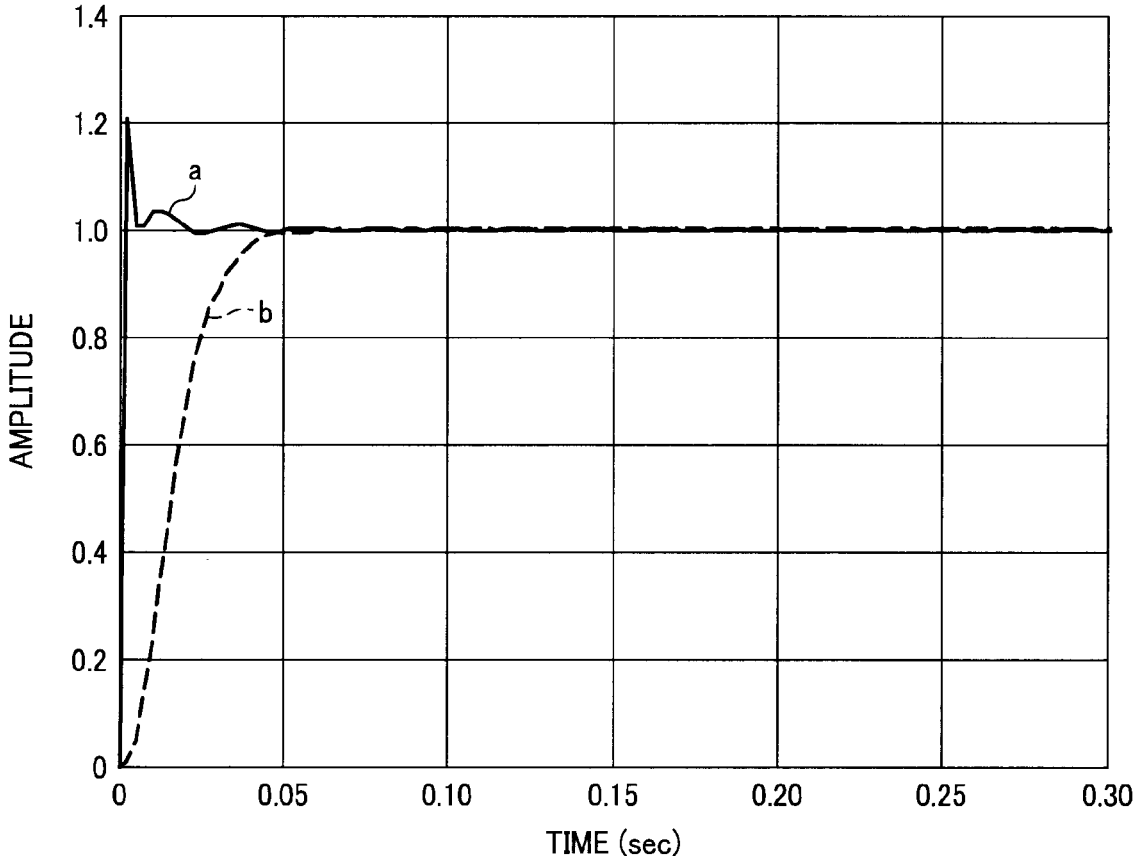
FIG. 19 is a graph illustrating a measurement result of a step response of a single loop control and a step response of a double loop control.

FIG. 19 is a graph illustrating the measurement result of the step response of the single loop control (a in the figure) and the step response of the double loop control (b in the figure). As will be noted from FIG. 19, in the single loop control (a in the figure), the phase margin is decreased because of the relationship between the improvement in the response frequency and the mechanical resonance frequency, and the overshoot of the amplification is relatively large. In this control system, a target value is provided in step in the single loop control, the overshoot is increased as illustrated in FIG. 19, so that it is better to use a target speed profile in which a target speed is increased smoothly.

Next, the operation when an abnormality is generated in the output of the encoder sensor 19 will be described. When an abnormality is generated in the encoder sensor 19, the switching section 42 is switched to the conversion factor section 38 side from the belt speed compensator 33 side, so as to switch the control from the double loop control to the single loop control. In addition, the switching of the switching section 42 is conducted by determining the operation sequence or the condition of the signal of the encoder sensor 19 in the speed calculator 30 for calculating the belt speed.

[Embodiment 6]

As illustrated in FIG. 20, the driving speed control unit 21 in this embodiment includes a switching section 43 provided in the downstream side of the belt speed compensator 33. Other structures are the same as the structures in the belt driving control section 21 illustrated in FIG. 8.

In this embodiment, the switching section 43 is turned off in the single loop control, and the switching section 43 is turned on in the double loop control. The switching between the single loop control and the double loop control is thereby conducted.

The switching section 43 can be achieved by a hardware switch made of a release switch, an analogue switch, or the like, or can be achieved by a software switch when the calculation of the control system is constituted of software. The switching operation of the switching section 43 can be performed by determining the operation sequence and the condition of the signal of the encoder sensor 19 in the belt speed calculator 30 for calculating the belt speed.

In this control system, when the switching section 43 is turned on, a value (target value of driving axis speed) which is provided to the driving axis speed control loop of a minor loop is an additional value of the belt target speed converted via the conversion factor section 38 and the output of the belt speed compensator 33. In the target speed of the minor loop, the output of the conversion factor section 38 becomes a main value, and the main value is corrected by the output of the belt speed compensator 33.

As described above, in the structure of this embodiment, even if the control is switched from the single loop control in which the switching section 43 is turned off to the double loop control in which the switching section 43 is turned on, the state variable value of the belt speed compensator 33 does not significantly change, so that the speed fluctuation in the switching of the switching section 43 can be controlled to be as small as possible.

Figure 21:
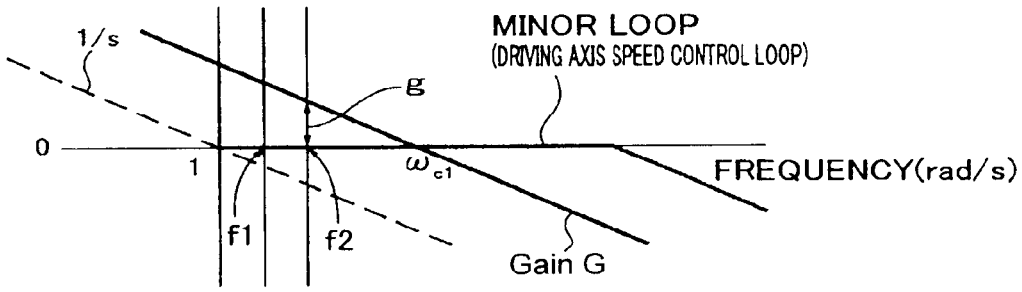
FIG. 21 is a graph describing a gain required for controlling disturbance to a desired value with the frequency of the variation in the thickness of the intermediate transfer belt and the rotation frequency of the driving axis.

Next, the response frequency of the belt speed control loop will be described. As described in each embodiment, the encoder pattern 24 for detecting the surface speed of the intermediate transfer belt 3 is provided in the front face and near the end portion of the intermediate transfer belt 3, so as to constitute the feedback control system for the belt surface speed. Accordingly, the variation component having a relatively low frequency which occurs after the encoder sensor 18 of the driving axis 14 can be controlled. Therefore, the load variation and eccentricity of the rotating body such as the driving axis 14, and the variation component such as the change in the thickness of the intermediate transfer belt 3 and the attachment eccentricity of the driving axis encoder sensor 18 can be controlled. For this reason, the thickness variation frequency of the intermediate transfer belt 3 and the rotation frequency of the driving axis 14 (driving roller 10) require gains for controlling the disturbance to a desired value. This will be described with reference to FIG. 21.

As described above, the driving axis speed control loop as a minor loop is provided inside the belt speed control loop, so as to obtain stability. Therefore, the low-pass gain of the driving axis speed control loop, which becomes the control target of the belt speed control loop, is 0 dB. If the belt speed compensator 33 includes an integral element which cancels a stationary error, the open-loop gain (1/s) of the belt speed control loop includes an inclination of −20 dB/dec in which 1 rad/s becomes a crossover frequency as illustrated in the figure.

In general, the driving axis frequency f2 is higher than the frequency f1 of the change in the thickness of the intermediate transfer belt 3, and the amplitude of the frequency f2 is larger than the amplitude of the frequency f1. In this case, the parameter is set such that a desired gain G is obtained in the driving axis frequency f2. More particularly, the proportional factor is set such that the inclination of the gain G becomes −20 dB/dec and the crossover frequency becomes ωc1 (g in the figure illustrates a required gain). As an example, if the belt speed compensator 21 includes a control format in which a simple integral element and a proportional element are arranged in series, the compensator expressed in a continuous system becomes (1/s)×ωc1.

In each embodiment described above, when the integral element calculation having a different arithmetic cycle is conducted in the belt speed calculator 30, the calculation of the proportional factor of ωc1 is conducted in the belt speed compensator 33. In an actual device, the mechanical resonance frequency of the belt mechanism 37 may be close to the crossover frequency ωc1. In order to stabilize that, or in order to obtain a robust high-pass noise, filter calculation, for example, a notch filter or a low-pass filter may be used.

Next, the response frequency of the driving axis speed control loop will be described. As described in each embodiment, the mechanical resonance frequency which affects the control system occurs by the inertia moment of the motor 15, the inertia moment of the belt mechanism 37 and the rigidity of the reduction mechanism 22 (hereinafter, referred to as a mechanical resonance frequency of the driving axis 14), and becomes a mechanical resonance frequency higher than the mechanical resonance frequency of the belt mechanism 37 (for example, 200 Hz relative to 50 Hz).

The output value of the encoder sensor 18 attached near the driving axis 14 is fed back, and the response frequency is set higher than the fluctuation component generated by the unstable rotation of the motor 15 and the eccentricity of the reduction mechanism 22. Thereby, the fluctuation component generated by the motor, the reduction mechanism or the like except for the encoder sensor 18 can be controlled. Accordingly, a gain for controlling the disturbance to a predetermined value with the rotation frequency of the motor 15 is required. This will be described with reference to FIG. 22.

Figure 22:
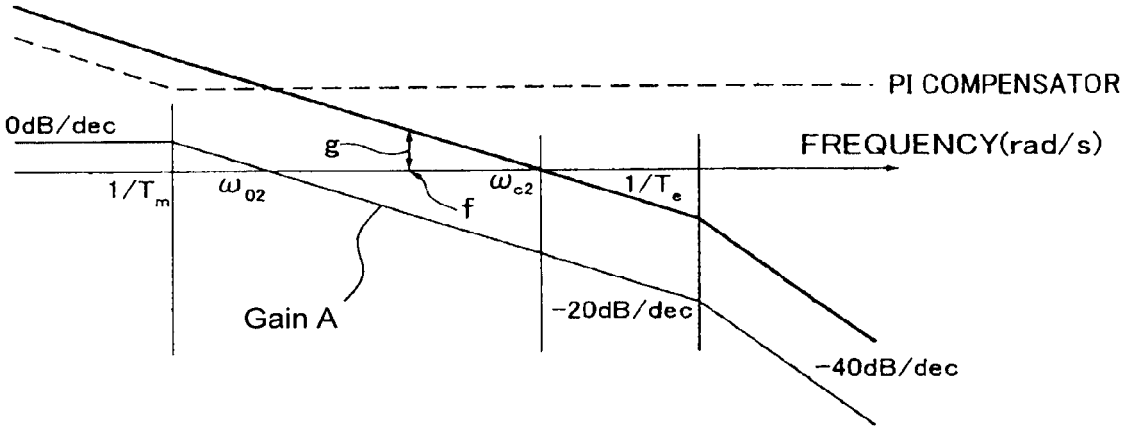
FIG. 22 is a graph describing a gain required for controlling disturbance to a desired value with the rotation frequency of the motor.

In FIG. 22, the control target of the driving axis speed loop will be described as a simple one inertia model without including the mechanical resonance frequency of the driving axis 14. In this case, the driving voltage of the motor 15 is considered. The control target includes an electric time constant Te and a mechanical time constant Tm of the motor 15. As illustrated in FIG. 22, the frequency which becomes the inverse of each time constant (1/Te and 1/Tm) is a break of a gain. Moreover, the gain (Gain A) as the control target becomes 0 dB/dec in 1/Tm or below, −20 dB / dec in 1/ Tm or more and 1/Tm or below, and −40 dB/dec in 1/Te or more.

At first, in order to compensate the shortage of low-pass (1/Tm or below) gain with the mechanical time constant, the integral element is used. In order to ensure a necessary gain g for controlling the rotation frequency f of the motor 15, the proportional element is used (PI element including the integral element and the proportional element). Since the integral element is input, the control system becomes type 1, so that the constant disturbance such as friction can be controlled. In addition, in order to obtain the effect by the control low-pass disturbance, a PI element may be added for increasing the low-pass gain larger than the PI element.

It is also necessary to set the response frequency of the control system to be higher than the rotation frequency of the motor 15, so as to ensure a gain for controlling the rotation frequency of the motor 15. In order to ensure the necessary gain g, the crossover frequency ω02 of the control target is improved to ω2 by the proportional element. Therefore, the driving axis speed compensator 35 of the driving axis speed loop can be designed such that the response frequency becomes ωc2 by the PI compensator having a format in which the integral element and the proportional element are added. In the actual compensator, the low-pass filter can be provided so as to be robust relative to a high-pass noise, or a derivative element can be provided for improving a response.

In the above, the belt speed compensator 33 and the driving axis speed compensator 35 are described according to class control logic. However, in the compensator using modern control logic or robust control logic, the same effect can be achieved although it has a different format, a different calculation method, or the like. As an actual method, in the modern control logic, a compensator is designed relative to an enlarged plant in which an integral element is previously input. In the modern control logic, the compensator is designed by providing the integral element, proportional element or the like as a frequency weight.

[Embodiment 7]

Figure 23:
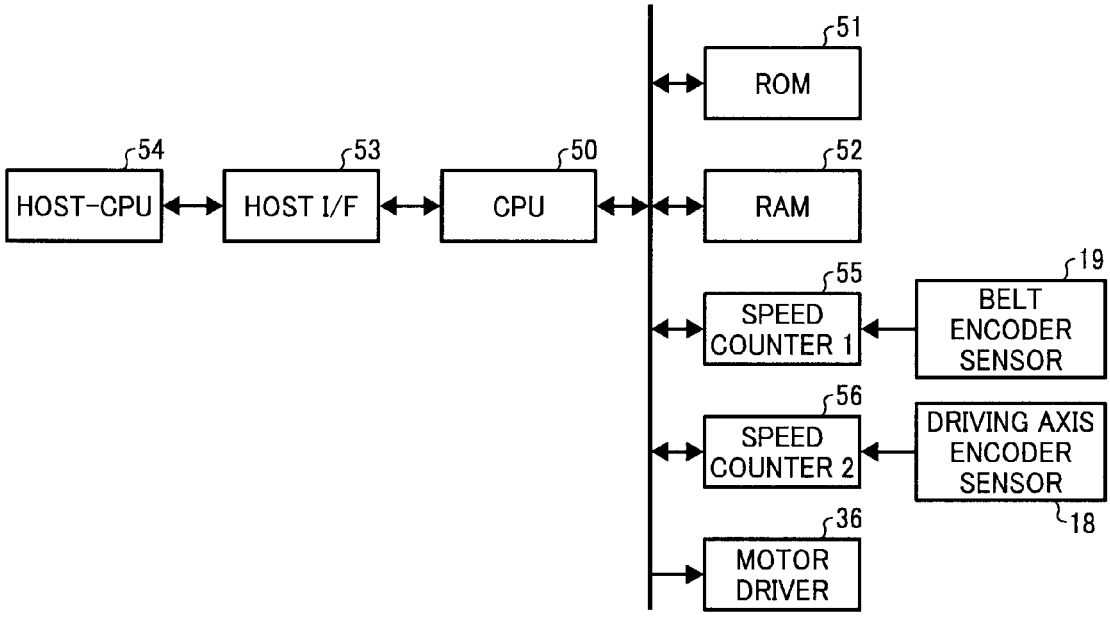
FIG. 23 is a block diagram illustrating one example of a structure including a speed counter of the belt driving control unit as hardware.

FIG. 23 is a block diagram illustrating one example of the structure of the belt driving control unit 21 having a speed counter as hardware.

As illustrated in FIG. 23, the belt driving control unit 21 includes a digital calculator comprising a CPU 30 (or DSP). The program which drives in this calculator is recorded in a ROM 51. The program is directly read by the CPU 50 from the ROM 51 so as to be performed. The program may be performed by developing in a RAM 52, so as to correspond to a high speed and the change in a parameter.

The ON/OFF of the control calculation and the setting of various parameters in the CPU are achieved by the communication with a HOST-CUP 54 which is a higher-level calculator via a HOST interface (HOST I/F). The HOST I/F 53 may be any interface such as a serial interface, a parallel interface or a common memory, and also a communication protocol may be any format.

Regarding the output (pulse output) from the encoder sensor 19, the interval between the edges of pulses is measured by a first speed counter 55. The count value is stored in a resistor. Regarding the output (pulse output) from the encoder sensor 18, the interval between the edges of pulses is measured by a second speed counter 56. The count value is stored in the resistor.

The control calculation is turned on by the driving (rotation) of the intermediate transfer belt 3, the control calculation is performed in a predetermined cycle by using timer interrupt inside the CPU 50. In this control calculation, the interval of the edges of the pulses is read from the resistors of the first and second speed counters 55, 56, so as to calculate the speed of the belt surface and the driving axis to be used for the control calculation. The result of the control calculation is written in the motor driver 36, and the motor 15 is driven.

In the structure illustrated in FIG. 23, the motor driver 36 has a structure in which the digital data can be directly written, but the motor driver 36 may receive PWM data or analogue data. In this case, a pulse oscillator which oscillates PWM or a D/A converter is provided, and various calculation results are provided to the oscillator or the D/A converter as digital data.

Figure 24:
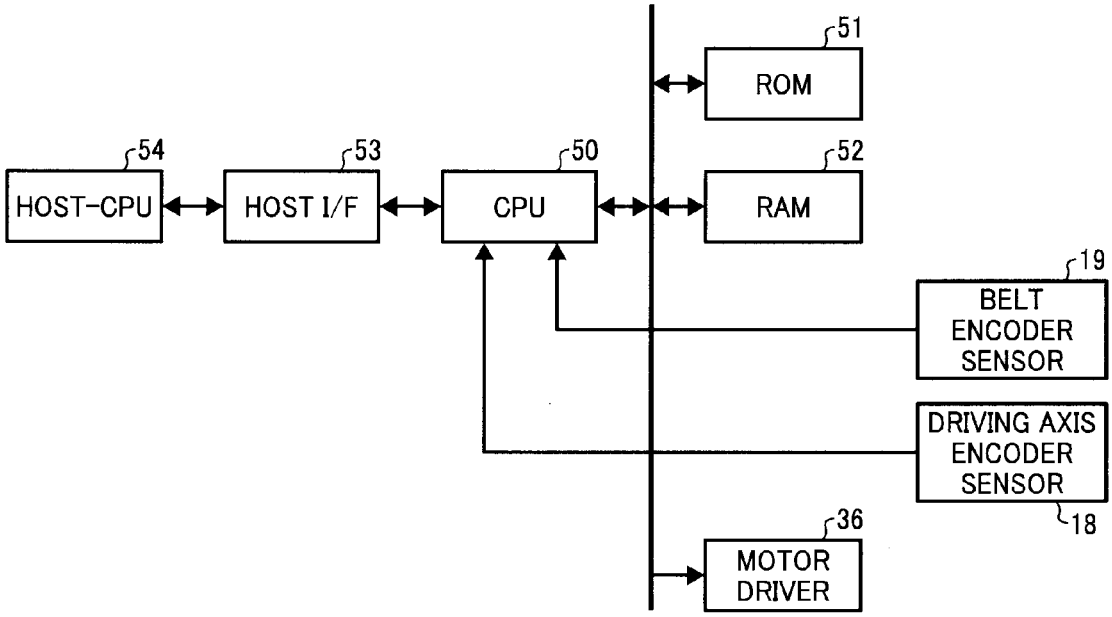
FIG. 24 is a block diagram illustrating one example of a structure which calculates the belt speed and the driving axis speed by the interrupt process of the calculator.
Figure 25A:
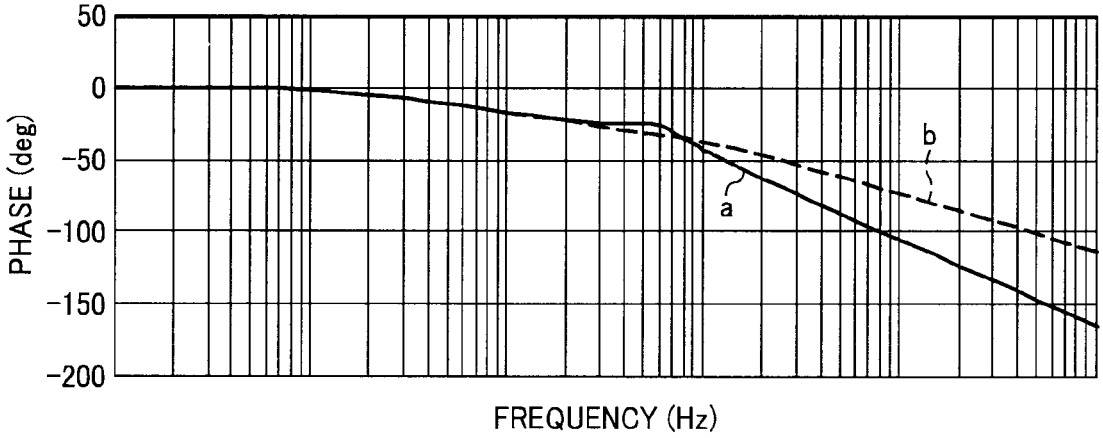
FIG. 25A is a graph illustrating a frequency response of the belt surface speed and the driving axis speed.
Figure 25B:
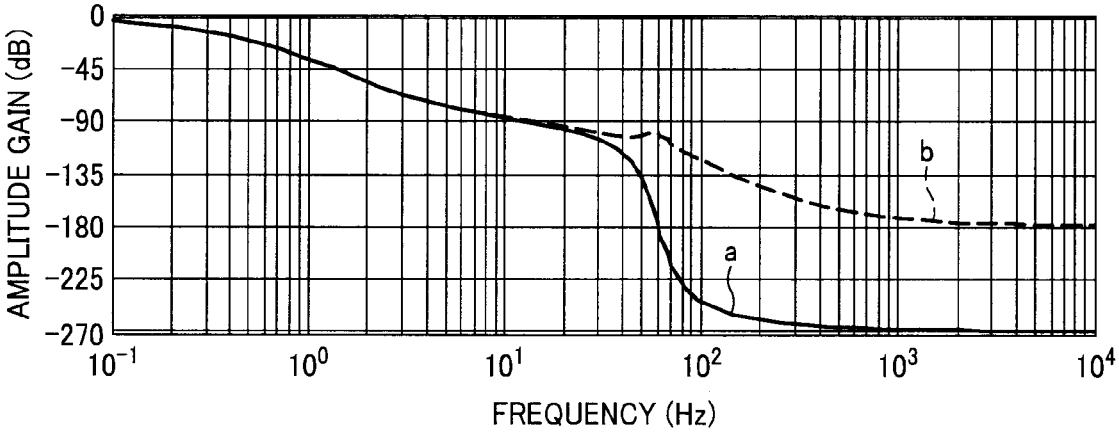
FIG. 25B is a graph illustrating another frequency response of the belt surface speed and the driving axis speed.

FIG. 24 is a view illustrating a structure which calculates a belt speed and a driving axis speed by an interrupt process of a calculator. Other structures are the same as the structures in FIG. 23.

In the structure illustrated in FIG. 24, the output (pulse output) of the encoder sensor 19 is input to the interrupt port of the CPU 50, and the interrupt routine of the belt speed calculation of the CPU is processed by the UP edge or the Down edge of the pulse, so that the belt speed is calculated. The output (pulse output) of the encoder sensor 18 is input to the interrupt port of the CPU 50, and the interrupt routine of the driving axis speed calculation of the CPU 50 is processed by the UP edge or the DOWN edge of the pulse, so that the driving axis speed is calculated.

The structure in FIG. 24 requires a calculator performance larger than the structure in FIG. 23 because the speed calculation is conducted by software. However, in the structure in FIG. 24, the filtering process or the like relative to the speed signal is easily conducted, and the degree of freedom regarding the speed calculation is large. In the structure in FIG. 24, the control calculation is performed in a predetermined cycle with the timer interrupt as described above, but the belt speed control loop such as belt speed compensator 33 is calculated by the output of the encoder sensor 19 and the driving axis speed control loop such as the driving axis speed compensator 35 may be conducted by the interrupt with the output of the encoder sensor 18. In this case, it is necessary to pay attention to the change in the response frequency of the control system by the driving axis speed.

According to one embodiment of the present invention, by providing the feedback loop for the belt surface speed in the first speed control loop and providing the feedback loop for the driving axis speed in the second speed control loop, the influence of the constant disturbance to the belt speed and the rotation error of the motor and the reduction mechanism can be controlled by the second speed control loop, and the influence of a low frequency such as the rotation error of the driving axis (driving roller), the variation in the thickness of the endless belt and the like can be controlled by the first speed control loop. Therefore, the belt driving controller capable of driving a belt with high accuracy can be provided.

In addition, since the speed detection mechanism by the calculator is provided, special hardware is not required. Accordingly, the belt driving controller capable of improving the degree of freedom such as the filtering process on the detected speed can be provided.

By conducting the filtering process on the detected speed, the belt driving controller which can improve a problem generated when the speed sampling and the control sampling are different to each other can be provided.

Moreover, the belt driving controller capable of controlling the speed difference of the belt surface speed can be provided by the integral element in the control calculation provided in the belt speed control compensator.

Furthermore, by simultaneously conducting the calculation in the integral element and the speed calculation, the belt driving controller which can improves the problem generated when the speed sampling and the control sampling are different to each other and control the speed difference of the belt surface speed can be provided.

Since the second speed control loop includes the adder which extracts a predetermined frequency component and adds the value to the control target value, the belt driving controller capable of controlling a specific frequency component which can not be controlled by a general gain set by the second speed compensator can be provided.

By conforming the calculation cycle of the filter which extracts a predetermined frequency component to the cycle of the second speed calculator, the belt driving controller having a structure which does not require the switching of the filter even if the belt surface speed is change can be provided.

By providing the switching section for control, the belt driving controller having a structure which can drive only by the second speed control loop can be provided.

By providing the adder which adds a predetermined value to the output of the first speed compensator, the belt driving controller capable of compensating the delay of the response of the first speed control loop can be provided.

Moreover, according to one embodiment of the present invention, the belt driving controller having a structure which can control the frequency component (mainly, the eccentricity component) of the variation in the thickness of the endless belt, and the rotation angle detector provided near the driving axis and the driving axis driving the endless belt can be provided.

Furthermore, according to one embodiment of the present invention, the belt driving controller having structure which can control the frequency component (mainly, the frequency of the motor rotation) of the motor by the second speed control loop can be provided.

Since the first speed compensator includes the unit which controls the mechanical resonance frequency caused by the inertia moment of the driving axis and the driven axis, the rigidity of the endless belt or the rigidity of the connected portion of the reduction mechanism can be achieved and the belt driving controller capable of stably driving a belt can be provided.

In addition, according to one embodiment of the present invention, by providing the above-described belt driving controller, the surface speed of the endless belt can be controlled with high accuracy, so that when the endless belt is the intermediate transfer belt, the surface speed of the intermediate transfer belt in the image forming operation can be controlled with high accuracy. Accordingly, the image forming device capable of forming a high quality image can be provided.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A belt driving controller, comprising:

a driving roller connected to a driving axis;

a plurality of driven rollers;

an endless belt provided to surround the driving roller and the driven rollers in a tensioned state;

a motor connected to the driving axis via a reduction mechanism;

a first detector provided near the driving axis and configured to detect a rotation angle of the driving axis;

a second detector configured to detect a displacement of the endless belt; and a control unit configured to control driving of the endless belt when driving by rotation of the motor, the control unit including: a first speed calculator configured to calculate a surface speed of the endless belt according a detected signal input from the second detector; a second speed calculator configured to calculate a driving axis speed according to a detected signal input from the first detector; a first speed control loop having a first speed compensator configured to compensate the surface speed of the endless belt by the comparison between a target speed of the endless belt and the surface speed of the endless belt calculated by the first speed calculator; and a second speed control loop having a second speed compensator configured to compensate the driving axis speed by the comparison between an output of the first speed compensator and an output of the second speed calculator.

2. The belt driving controller according to claim 1, wherein the second detector is configured to detect the displacement of the endless belt by detecting a marker provided in the endless belt, the control unit includes a digital calculator configured to perform control calculation, the first speed calculator is configured to calculate the surface speed of the endless belt with software of the digital calculator in accordance with a pulse signal generated by the marker provided in the endless belt, and the second speed calculator is configured to calculate the rotation speed of the driving axis with the software of the digital calculator in accordance with an output pulse signal of the first detector.

3. The belt driving controller according to claim 1, wherein in the first speed calculator, a speed difference is obtained by the comparison between the target speed of the endless belt and the surface speed of the endless belt, and a low-pass filtering process is conducted on the speed difference, and then the value calculated by the filtering process is provided to the first speed compensator.

4. The belt driving controller according to claim 1, wherein the first speed compensator includes an integral element in a control calculation in the control unit.

5. The belt driving controller according to claim 4, wherein in the first speed calculator, a speed difference is calculated by the comparison between the target speed of the endless belt and the surface speed of the endless belt, an integration calculation is conducted, and then the calculated value is provided to the first speed compensator.

6. The belt driving controller according to claim 1, wherein the second speed control loop includes a filtering unit configured to extract only a predetermined frequency from a speed difference between a target speed of the driving axis which is input to the second speed control loop and is the output of the first speed compensator and the driving axis speed which is the output of the second speed calculator and an adder configured to multiply the output of the filtering unit by a predetermined gain, and add the calculated value to the output of the second speed compensator.

7. The belt driving controller according to claim 6, wherein a calculation in the filtering unit is performed by the second speed calculator.

8. The belt driving controller according to claim 1, wherein the second speed control loop includes a filtering unit configured to extract only a predetermined frequency from the driving axis speed which is the output of the second speed calculator, and an adder configured to multiply the output of the filtering unit by a predetermined gain, and add the calculated value to the output of the second speed compensator.

9. The belt driving controller according to claim 1, further comprising a switching section configured to switch the target speed of the second speed control loop into the output of the first speed compensator or a value in which the target speed of the belt is multiplied by a predetermined gain.

10. The belt driving controller according to claim 1, further comprising an adder configured to multiply the target speed of the belt by a predetermined gain, and add the calculated value to the output of the first speed compensator, wherein the output of the adder is used as a target speed of the second speed control loop.

11. The belt driving controller according to claim 1, further comprising a switching section configured to turn on or off the output of the first speed compensator as a target speed of the second speed control loop.

12. The belt driving controller according to claim 1, wherein the first speed compensator sets a response frequency of the first speed control loop higher than a frequency of variation in a thickness of the endless belt and a rotation frequency of the driving axis.

13. The belt driving controller according to claim 1, wherein the second speed compensator sets a response frequency of the second speed control loop higher than a rotation frequency of the motor.

14. The belt driving controller according to claim 1, wherein the first speed compensator includes a unit configured to control a mechanical resonance generated by at least one of an inertia moment of the driving and driven rollers, a rigidity of the endless belt, and a rigidity of the connected portion of the reduction mechanism.

15. An image forming device comprising a belt driving controller, the belt driving controller, including:

a driving roller connected to a driving axis;

a plurality of driven rollers;

an endless belt provided to surround the driving roller and the driven rollers in a tensioned state;

a motor connected to the driving axis via a reduction mechanism;

a first detector provided near the driving axis and configured to detect a rotation angle of the driving axis;

a second detector configured to detect a displacement of the endless belt; and a control unit configured to control driving of the endless belt when driving by rotation of the motor, the control unit including: a first speed calculator configured to calculate a surface speed of the endless belt according a detected signal input from the second detector; a second speed calculator configured to calculate a driving axis speed according to a detected signal input from the first detector; a first speed control loop having a first speed compensator configured to compensate the surface speed of the endless belt by the comparison between a target speed of the endless belt and the surface speed of the endless belt calculated by the first speed calculator; and a second speed control loop having a second speed compensator configured to compensate the driving axis speed by the comparison between an output of the first speed compensator and an output of the second speed calculator.

16. The image forming device according to claim 15, wherein the endless belt is an intermediate transfer belt on which a plurality of color images formed on photoconductors, respectively, is superimposed to be transferred.

* * * * *